US006946629B2

(12) United States Patent
Miyahara et al.

(10) Patent No.: US 6,946,629 B2
(45) Date of Patent: Sep. 20, 2005

(54) INDUCTION HEATING TYPE FIXING DEVICE FOR AN IMAGE FORMING APPARATUS AND INDUCTION HEATING COIL THEREFOR

(75) Inventors: Akiko Miyahara, Tokyo (JP); Toshiaki Higaya, Kanagawa (JP); Masae Sugawara, Miyagi (JP); Tomotaka Takamura, Miyagi (JP)

(73) Assignees: Ricoh Company, Ltd., Tokyo (JP); Tohoku Ricoh Co., Ltd., Miyagi (JP)

( * ) Notice: Subject to any disclaimer, the term of this patent is extended or adjusted under 35 U.S.C. 154(b) by 0 days.

(21) Appl. No.: 10/810,834

(22) Filed: Mar. 29, 2004

(65) Prior Publication Data

US 2004/0188423 A1 Sep. 30, 2004

Related U.S. Application Data

(62) Division of application No. 09/842,880, filed on Apr. 27, 2001, now Pat. No. 6,753,515.

(30) Foreign Application Priority Data

| | | |
|---|---|---|
| Apr. 28, 2000 | (JP) | 2000-130934 |
| Apr. 28, 2000 | (JP) | 2000-130935 |
| Jul. 31, 2000 | (JP) | 2000-231577 |
| Aug. 7, 2000 | (JP) | 2000-238403 |
| Feb. 27, 2001 | (JP) | 2001-050654 |

(51) Int. Cl.[7] ..... H05B 6/14; G03G 15/20

(52) U.S. Cl. ..... 219/619; 219/656; 219/662; 219/674; 219/676; 399/328; 399/330

(58) Field of Search ..... 219/619, 656, 219/660–662, 670–676; 399/328–338

(56) References Cited

U.S. PATENT DOCUMENTS

| | | | | |
|---|---|---|---|---|
| 2,583,854 A | | 1/1952 | Kehbel | |
| 3,958,328 A | | 5/1976 | Lee | |
| 5,376,774 A | * | 12/1994 | McGaffigan et al. | 219/624 |
| 5,523,550 A | | 6/1996 | Kimura | |
| 5,832,354 A | * | 11/1998 | Kouno et al. | 399/330 |
| 5,999,774 A | * | 12/1999 | Masuda et al. | 399/155 |
| 6,337,969 B1 | * | 1/2002 | Takagi et al. | 399/330 |

FOREIGN PATENT DOCUMENTS

| | | |
|---|---|---|
| JP | 8-179647 | 7/1996 |
| JP | 10-10901 | 1/1998 |
| JP | 10-20704 | 1/1998 |
| JP | 10-153918 | 6/1998 |
| JP | 10-282826 | 10/1998 |
| JP | 11-316509 | 11/1999 |
| JP | 2000-56598 | 2/2000 |
| JP | 2000-66543 | 3/2000 |
| JP | 2000-105518 | 4/2000 |

* cited by examiner

*Primary Examiner*—Philip H. Leung
(74) *Attorney, Agent, or Firm*—Oblon, Spivak, McClelland, Maier & Neustadt, P.C.

(57) ABSTRACT

An induction heating type fixing device for an electrophotographic image forming apparatus is disclosed. An inducting heating coil has a plurality of bobbins each having a particular diameter and assembled in a telescopic manner. A particular conductor is wound round each bobbin beforehand with leads being laid inside of the conductor. The bobbin may be implemented as a plurality of bobbin members removably connected together.

25 Claims, 21 Drawing Sheets

15
23L
11
6
13
12
22R
21R
21L
(21R)
W
D
A 1
15a
22R, 23L
21
W
D
A
13
23L
15a
11
22R
12
15
21R
15
21L

INDUCTION HEATING TYPE FIXING DEVICE FOR AN IMAGE FORMING APPARATUS AND INDUCTION HEATING COIL THEREFOR

CROSS-REFERENCE TO RELATED APPLICATION

The present application claims benefit of priority under 35 U.S.C. § 119 to Japanese Patent Application 2000-130934 filed Apr. 28, 2000, Japanese Patent Application 2000-130935 filed Apr. 28, 2000, Japanese Patent Application 2000-23 1577 filed Jul. 31, 2000, Japanese Patent Application 2000-238403 filed Aug. 7, 2000, and Japanese Patent Application 2001-050654 filed Feb. 26, 2001, and is a division 35 U.S.C. § 120 to, U.S. patent application Ser. No. 09/842,880 filed Apr. 27, 2001 now U.S. Pat. No. 6,753,515. The entire contents of which are incorporated herein by reference.

BACKGROUND OF THE INVENTION

The present invention relates to a fixing device for a printer, facsimile apparatus, copier or similar electrophotographic image forming apparatus and more particularly to an induction heating type fixing device using electromagnetic induction. Further, the present invention relates to an induction coil for use in the induction heating type fixing device.

Generally, an image forming apparatus includes a fixing device for fixing a toner image on a paper sheet or similar recording medium. One of conventional fixing device uses a heat roller to be heated and a press roller pressed against the heat roller. The heat roller and press roller fix a toner image on a paper sheet with heat and pressure while conveying the paper sheet. A halogen lamp, halogen heater or similar heat source has traditionally been disposed in the heat roller for heating the heat source to a preselected temperature necessary for fixation.

It is a common practice with the above-described fixing device to heat the heat roller to a preselected surface temperature, e.g., 180° C. and then maintain it at a temperature that is about 50% to 90% of the above temperature, e.g., 120° C. This allows a person to use the image forming apparatus without wasting time. However, even when the fixing device is held in a stand-by state at, e.g., 120° C., it naturally consumes much power. From the energy saving standpoint, the fixing device should consume a minimum of energy even in the stand-by state.

In light of the above, there have been proposed various fixing systems featuring a short warm-up time and therefore allowing power supply to be shut off when in a stand-by state. Particularly an induction heating type fixing system is attracting increasing attention because it heats a heat roller, which is formed of conductive metal, by using eddy current derived from an electromagnetic wave.

In an induction heating type fixing device, if the range over which an induction coil is wound differs from a sheet passing width, then so-called hot offset occurs due to excessive temperature elevation in ranges that a paper sheet does not pass. Japanese Patent Laid-Open Publication No. 2000-133627, for example, discloses an induction heating type fixing device capable of obviating hot offset and reducing wasteful power consumption. The fixing device disclosed includes a main coil and an auxiliary coil assigned to a range covering small paper sizes and a range outside of the above range, respectively. The main coil and auxiliary coil are wound round a single bobbin and controlled independently of each other as to current supply. The gap between the coils and a heat roller should preferably be as small as possible in order to efficiently heat the heat roller. To reduce the gap, the end portions of the auxiliary coil are laid inside of the bobbin.

In the configuration taught in the above-mentioned document, the auxiliary coil is positioned at opposite end portions of the bobbin while the main coil is positioned at the center of the same. This brings about a problem that the main coil is laid inside of the bobbin, making it difficult to deal with the end portions of the coils. Further, when any part of the coils snaps, all the coils must be rewound. A period of time necessary for rewinding work is so long, the coils are bodily replaced, i.e., even the coil not snapped is discarded.

On the other hand, the warm-up time of the fixing device can be reduced if the thermal capacity of the heat roller is reduced. For this purpose, the wall thickness of the heat roller may be reduced, as proposed in the past. This, however, brings about another problem that substantially no heat conduction occurs in the heat roller in the axial direction because the heat roller has a core whose thermal conductivity is relatively low. To solve this problem, there has been proposed a system in which a plurality of coils are selectively energized in accordance with sheet size. This allows only necessary part of the heat roller to be heated and thereby further saves energy.

The plurality of coils, however, require a number of leads to be laid between the heat roller and the coils. Therefore, to protect the coils from damage ascribable to, e.g., short-circuiting, a sufficient gap is necessary between the heat roller and the coils and leads. Such a gap increases the distance between the coils and the heat roller and thereby aggravates thermal conversion efficiency. Moreover, a number of leads increase the number of wiring steps and therefore production cost.

Technologies relating to the present invention are also disclosed in, e.g., Japanese Patent Laid-Open Publication Nos. 10-10901, 10-20704, 10-153918, 10-282826, 11-316509, 2000-105518, and 2000-56598.

SUMMARY OF THE INVENTION

It is a first object of the present invention to provide an induction heating type fixing device capable of accurately controlling the surface temperature of a heat roller for thereby reducing hot offset, an induction heating coil therefor, and a method of producing the coil.

It is a second object of the present invention to provide a low cost, induction heating type fixing device capable of promoting stable heating without lowering thermal conversion efficiency, an induction heating coil therefor, and a method of producing the coil.

It is a third object of the present invention to provide an induction heating type fixing device easy to produce and repair, an induction heating coil therefor, and a method of producing the coil.

It is a fourth object of the present invention to provide an image forming apparatus including the induction heating type fixing device stated above.

In accordance with the present invention, in an induction heating coil including a bobbin formed of a heat-resistant material and a conductor wound round the bobbin, a particular conductor is wound round each of a plurality of bobbins having different diameters and assembled in a telescopic manner.

Also, in accordance with the present invention, an induction heating type fixing device for fixing a toner image on a recording medium, the induction heating type device includes two rollers for conveying the recording medium while nipping it, and an induction heating coil associated with at least one of the rollers for generating an induction magnetic flux. The induction heating coil has a plurality of bobbins formed of a heat-resistant material and each having a particular diameter. The bobbins are assembled in a telescopic manner. A plurality of conductors each are wound round one of the bobbins.

Further, in accordance with the present invention, in an image forming apparatus including an induction heating type fixing device for fixing a toner image on a recording medium, the induction heating type fixing device includes two rollers for conveying the recording medium while nipping it, and an induction heating coil associated with at least one of the two rollers for generating an induction magnetic flux. The induction heating coil has a plurality of bobbins formed of a heat-resistant material and each having a particular diameter. The bobbins are assembled in a telescopic manner. A plurality of conductors each are wound round one of the bobbins.

Moreover, in accordance with the present invention, in a method of producing an induction heating coil for an induction heating type fixing device and including a bobbin for supporting conductors, the bobbin is implemented as a plurality of bobbin members removably connected to each other. After a particular conductor has been wound on each bobbin member, the bobbin members are assembled.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Figure 1:
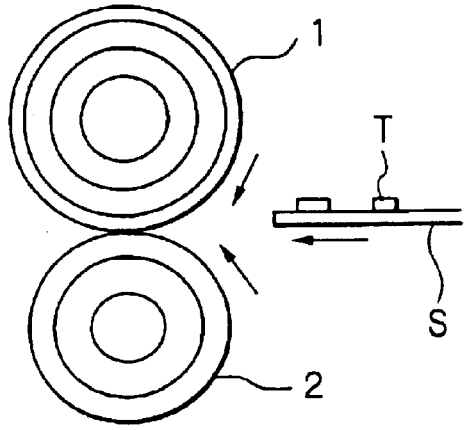
Fig. 1 PRIOR ART
FIG. 1 is a view showing the general construction of a conventional fixing device.

To better understand the present invention, brief reference will be made to a conventional fixing device applicable to an image forming apparatus, shown in FIG. 1. As shown, the fixing device includes a heat roller 1 and a press roller 2 pressed against the heat roller 1. The heat roller 1 and press roller 2 fix a toner image T formed on a sheet S with heat and pressure while conveying the sheet S. A halogen lamp, halogen heater or similar heating means is disposed in the heat roller 1 for heating the heat roller 1 to a preselected temperature.

It is a common practice with the above-described fixing device to heat the heat roller 1 to a preselected surface temperature, e.g., 180° C. and then maintain it at a temperature that is about 50% to 90% of the above temperature, e.g., 120° C. This allows a person to use the image forming apparatus without wasting time. However, even when the fixing device is held in a stand-by state at, e.g., 120° C., it naturally consumes much power. From the energy saving standpoint, the fixing device should consume a minimum of energy even in the stand-by state.

In light of the above, there have been proposed various fixing systems featuring a short warm-up time and therefore allowing power supply to be shut off when in a stand-by state. An induction heating type fixing system is one of such fixing systems and heats a heat roller, which is formed of conductive metal, by using eddy current derived from an electromagnetic wave.

Figure 2:
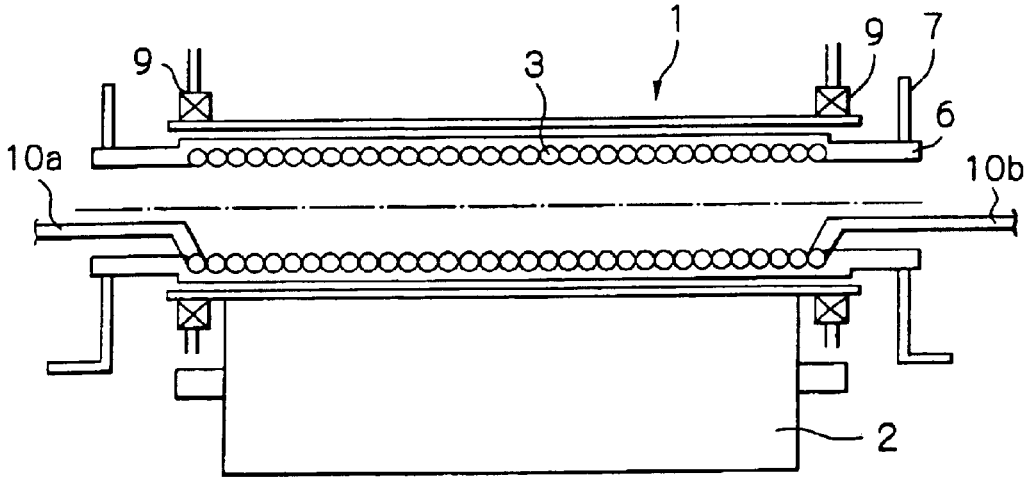
Fig. 2 PRIOR ART
FIG. 2 is a view showing a conventional induction heating type fixing device including an induction heating coil.

FIG. 2 shows a specific configuration of a fixing device using the induction heating type fixing system. As shown, the fixing device includes a hollow heat roller 1 and a press roller 2 pressed against the heat roller 1. The heat roller 1 is formed of conductive metal and journalled to brackets 7 via bearings 9. The press roller 2 is rotatable in contact with the heat roller 1. A gear, not shown, is mounted on one end of the heat roller 1 and held in mesh with a drive bear not shown. When the heat roller 1 is caused to rotate by the drive gear, it causes the press roller 2 to rotate. Specifically, the heat roller 3 includes a core formed of stainless steel, iron or similar magnetic material and a parting layer covering the core. The parting layer is formed of fluorocarbon resin.

An induction heating coil 3 is spirally wound round a hollow cylindrical bobbin 6 and disposed in the heat roller 1. The coil 3 is implemented by, e.g., a litz wire while the bobbin 6 is formed of heat-resistant resin, ceramics or similar nonmagnetic insulating material. The coil 3 has leads 10*a* and 10*b* at opposite ends thereof. When a high-frequency current flows through the leads 10*a* and 10*b* and coil 3, it forms a high-frequency electric field. As a result, eddy current is induced in the heat roller 1 and heats the roller 1 to a preselected surface temperature on the basis of Joule heat.

Figure 3:
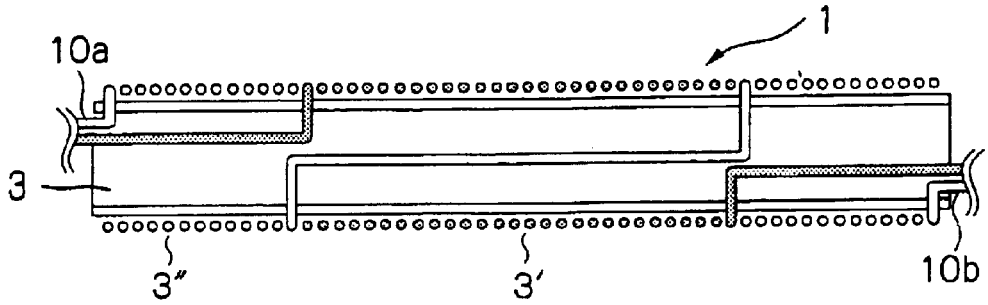
Fig. 3 PRIOR ART
FIG. 3 is a section showing a conventional induction heating coil.

FIG. 3 shows an induction heating type fixing device proposed in Japanese Patent Application No. 2000-133627mentioned earlier and constructed to avoid hot offset and to reduce wasteful power consumption. As shown, the fixing device includes a main induction coil 3' and an auxiliary induction coil 3" that are wound round a single bobbin 6. The main coil 3' covers a range corresponding to small sheet sizes while the auxiliary coil 3" covers ranges outside of the above range. Current supply to the main coil 3' and current supply to the auxiliary coil 3" are controlled independently of each other. The end portions of the auxiliary coil 3" are laid inside the bobbin 6 in order to reduce the gap between the heat roller 1 and the coils 3' and 3". This allows the coils 3' and 3" to efficiently heat the heat roller 1.

The fixing device shown in FIG. 3 has the following problems left unsolved. The auxiliary coil 3" is wound on opposite end portions of the single bobbin 6 while the main coil 3' between the auxiliary coils 3" has its opposite end portions laid inside the same bobbin 6. This configuration makes it difficult to deal with the end portions of the coils 3' and 3" and therefore to produce the heating device. Further, when any part of the coils 3' and 3" snaps, the coils 3' and 3" must be rewound. A period of time necessary for rewinding work is so long, the coils 3' and 3" are bodily replaced, i.e., even the coil not snapped is discarded.

Figure 4:
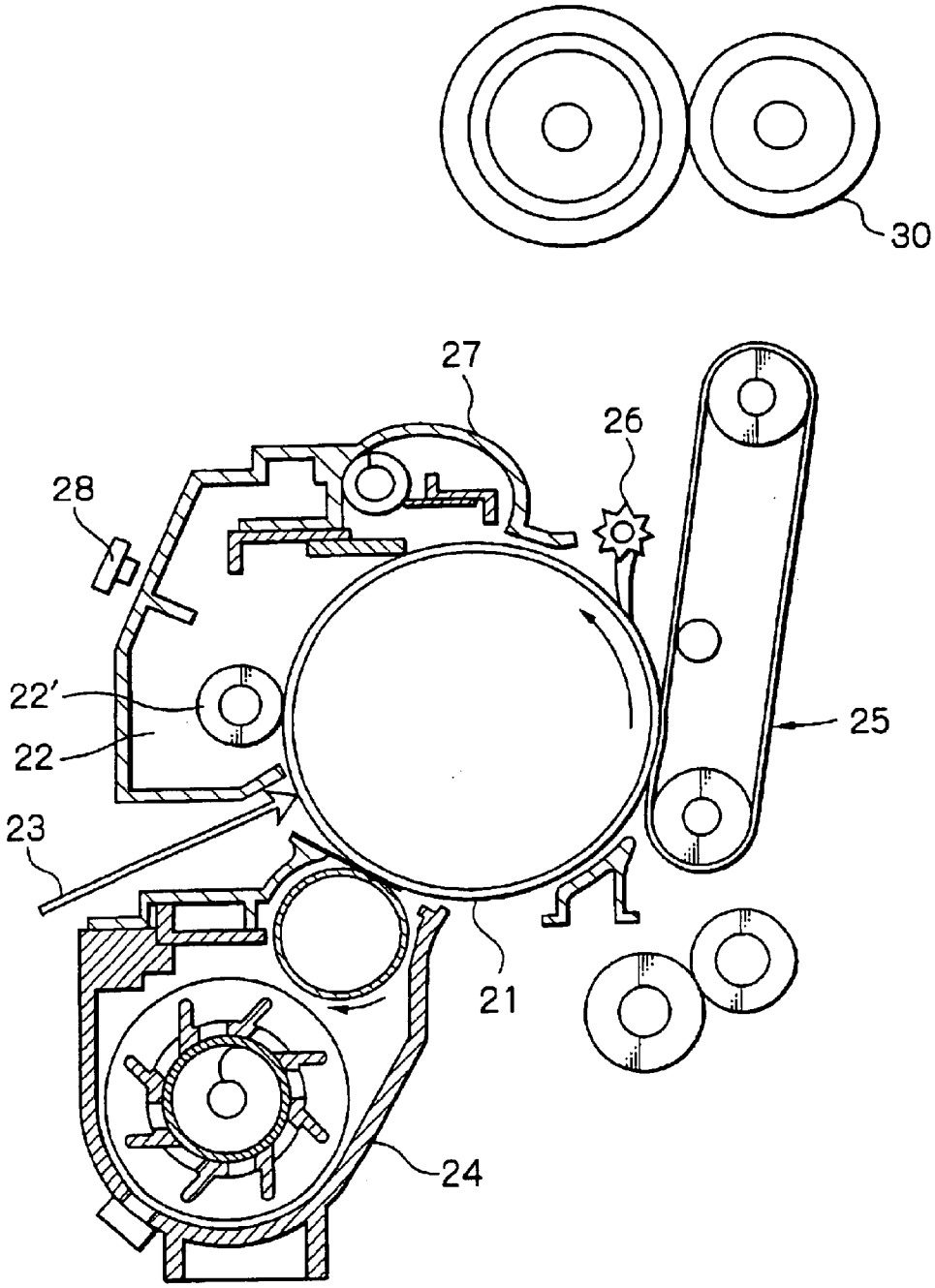
FIG. 4 is a view showing an image forming apparatus embodying the present invention.

Referring to FIG. 4, an image forming apparatus to which an induction heating type fixing device embodying the present invention is applied is shown. This embodiment is directed toward the first object stated earlier. As shown, the image forming apparatus basically has a conventional construction and includes a photoconductive drum or image carrier 21. Arranged around the drum 21 are a charger 22, a laser beam 23 representative of scanning optics, a developing device 24, an image transferring device 25, a cleaning device 27, and a discharger 28.

The charger 22 uniformly charges the surface of the drum 21. The laser beam 23 scans the charged surface of the drum 21 to thereby form a latent image on the drum 21. The developing device 24 deposits charged toner on the latent image to thereby produce a corresponding toner image. The image transferring device 25 transfers the toner image from the drum 21 to a paper sheet or similar recording medium. The cleaning device 27 removes the toner, left on the drum 21 after the image transfer. The discharger 28 discharges potential left on the drum 21 for thereby preparing the drum 21 for another image formation.

Assume that the image forming apparatus forms an image by negative-to-positive development, i.e., by causing the toner to deposit on the portions of the drum 21 where potential is low. Then, after a charge roller 22' included in the charger 22 has uniformly charged the surface of the drum 21, the laser beam 23 forms a latent image on the drum 21. The developing device 24 develops the latent image to thereby form a corresponding toner image. The image transferring device 25, which includes a belt, transfers the toner image from the drum 21 to a paper sheet or similar recording medium, not shown, fed from a tray not shown. At this instant, a peeler 26 peels off the paper sheet electrostatically adhering to the drum 21. A fixing device 30 fixes the toner image on the paper sheet. The cleaning device 27 removes and collects the toner left on the drum 21 without being transferred to the paper sheet. Subsequently, the discharger 28 discharges potential left on the drum 21.

Figure 5:
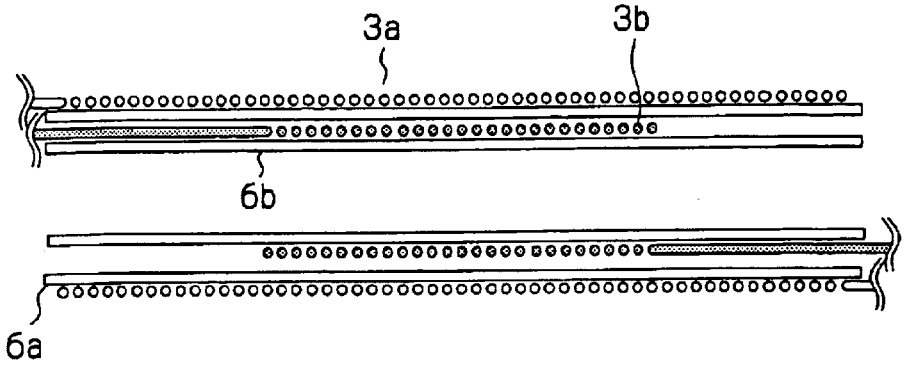
FIG. 5 is a section showing an induction heating coil included in the illustrative embodiment.

FIG. 5 shows an induction heating coil embodying the present invention and included in the fixing device 30. The general construction of the fixing device 30 is identical with the construction of the fixing device shown in FIG. 2 and will not be described specifically. As shown, an outer bobbin 6*a* accommodates an inner bobbin 6*b* smaller in diameter than the bobbin 6*a* in a double wall structure. A coil or conductor 3*a* is wound round the entire outer bobbin 6*a* while a coil or conductor 3*b* is wound round only the intermediate portion of the inner bobbin 6*b*. More specifically, the coil 3*a* extends over the maximum or effective sheet passing width. On the other hand, the coil 3*a* extends only over the center part of the effective sheet passing width. It is to be noted that a conductor refers to a non-insulated single wire, an insulated single wire or magnet wire or a plurality of magnet wires twisted together, i.e., a litz wire.

Figure 6:
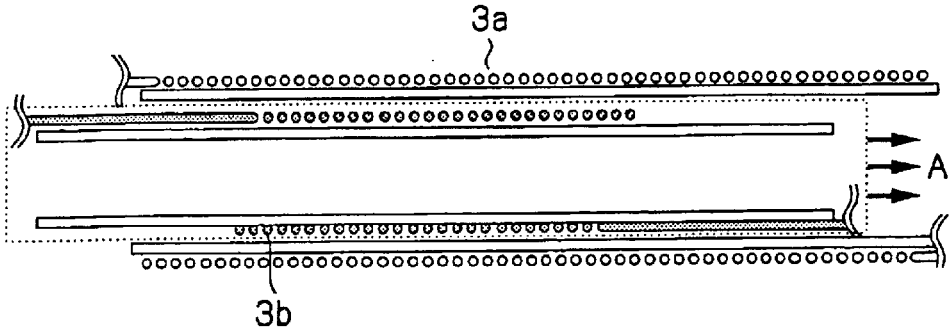
FIGS. 6 and 7 are views each showing a particular modification of the induction heating coil of the illustrative embodiment.

As shown in FIG. 6, the inner bobbin 6*b* with the coil 3*b* is inserted into the outer bobbin 6*a* with the coil 3*a* in a direction indicated by an arrow A. In this configuration, the coils 3*a* and 3*b* should only be wound round the bobbins 6*a* and 6*b*, respectively, and are therefore easy to configure. Further, when either one of the coils 3*a* and 3*b* snaps, only the snapped coil should be replaced. While the end portions of the coils 3*a* and 3*b* are shown as being laid outside of the respective bobbins 6*a* and 6*b*, the former may be laid inside of the latter.

Figure 7:
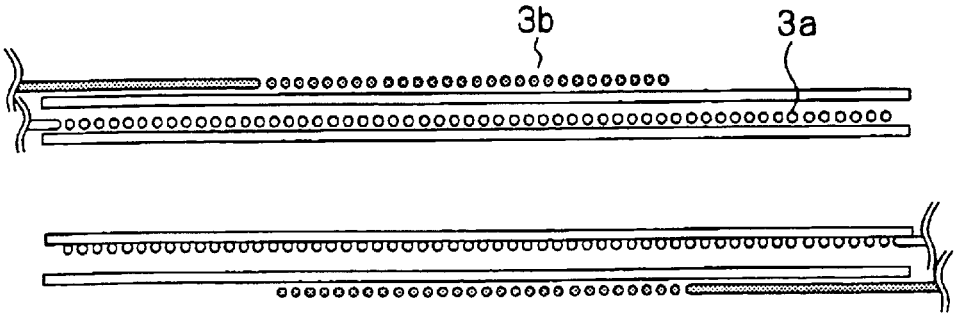

FIG. 7 shows an alternative configuration in which the coil 3*a* is wound round the inner bobbin while the coil 3*b* is wound round the outer bobbin. In any case, the outer coil is more efficient than the inner coil because the gap between the outer coil and the core of a heat roller is small. It is therefore preferable to position one coil expected to be mainly used for fixation outside of the other coil.

It should be noted that the width and the number of turns of each coil shown in FIGS. 5 through 7 are only illustrative and may be suitably varied in accordance with the sheet passing width and a reference position (center or end) for sheet passage available with an image forming apparatus.

Figure 8A:
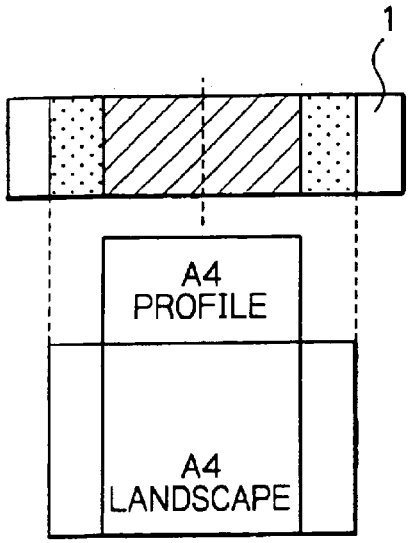
FIG. 8A shows a recording medium fed with the center used as a reference.
Figure 8B:
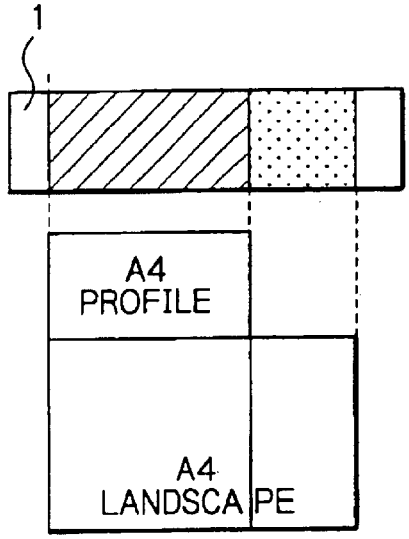
FIG. 8B shows a recording medium fed with one edge used as a reference.

FIG. 8A shows a relation between a heat roller 1 and a paper sheet being conveyed by the heat roller 1 with the center used as a reference. FIG. 8B shows a relation between the heat roller 1 and the paper sheet being conveyed with one edge used as a reference. Assume that part of the heat roller 1 over which the paper sheet passes in both of an A4 profile position and an A4 landscape position is a main sheet passing range, as indicated by hatching. Also, assume that part of the heat roller 1 over which the paper sheet passes in an A4 profile position, but does not pass in an A4 landscape position, is an auxiliary sheet passing range or ranges, as indicated by dots. The following description will concentrate on the maximum sheet passing width corresponding to the landscape position of size A4 and a relation between an A4 landscape position and an A4 profile position. However, the illustrative embodiment is, of course, practicable even with a greater or a smaller sheet passing width.

Figure 9:
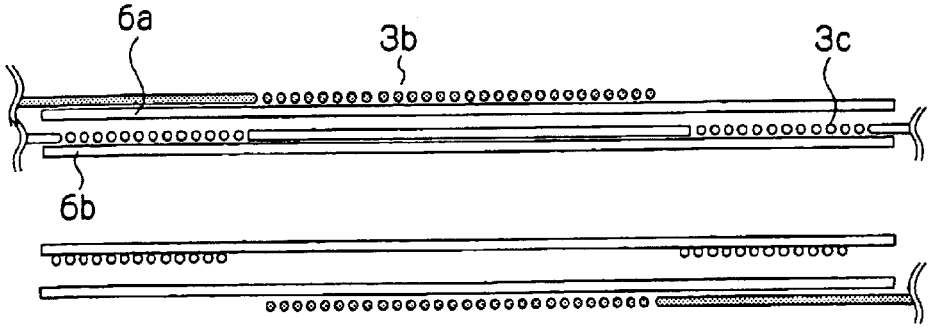
FIGS. 9 through 11 are sections each showing a particular further modification of the illustrative embodiment.

FIG. 9 shows a specific configuration of the induction heating coil applicable to the case wherein the paper sheet is passed with the center used as a reference. As shown, the coil is made up of coils or conductors 3*b* and 3*c* wound round the outer bobbin 6*a* and inner bobbin 6*b*, respectively. The coils 3*b* and 3*c* respectively cover the main range and auxiliary ranges of the heat roller shown in FIG. 8A. The coils 3*b* and 3*c* are controlled independently of each other as in the conventional configuration. Specifically, to deal with the maximum sheet size, current is fed to both of the coils 3*b* and 3*c* while, to deal with smaller sheet sizes, current is fed only to the coil 3*b*.

The coils 3*b* and 3*c* are easy to assemble. Moreover, when either one of the coils 3*b* and 3*c* snaps, only the snapped coil should be replaced. For example, when the maximum sheet passing width is 297 mm corresponding to the A4 landscape position, the coil 3*b* at the center should preferably have a width of 210 mm to 270 mm, which is equal to or greater than the A4 profile size of 210 mm by up to 60 mm. Such a width of the coil 3*b* is selected in consideration of heat radiation at opposite ends. With this configuration, it is possible to efficiently fix an image carried on a paper sheet without regard to the sheet width.

Figure 10:
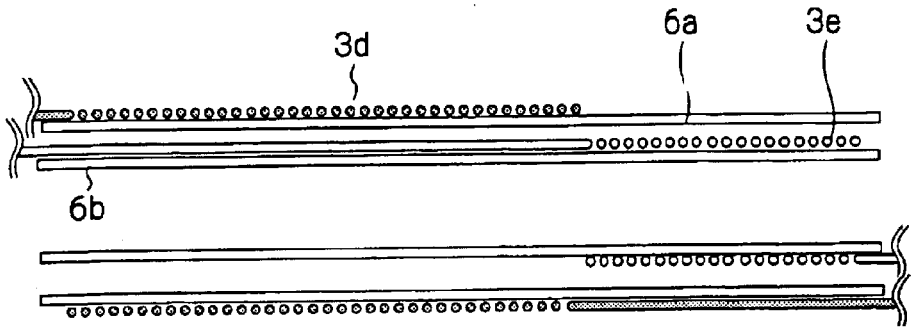

FIG. 10 shows a specific configuration of the induction heating coil applicable to the case wherein the paper sheet is passed with one edge used as a reference. As shown, the coil is made up of a main coil 3*d* and an auxiliary coils 3*e* wound round the outer bobbin 6*a* and inner bobbin 6*b*, respectively. The main coil 3*d* and auxiliary coil 3*e* respectively cover the main range and auxiliary range shown in FIG. 8B. The main coil 3*d* and auxiliary coil 3*e* are also controlled independently of each other as in the conventional configuration. Specifically, to deal with the maximum sheet size, current is fed to both of the coils 3*d* and 3*e* while, to deal with smaller sheet sizes, current is fed only to the coil 3*d*. Again, when the maximum sheet passing width is 297 mm corresponding to the A4 landscape position, the main coil 3*d* should preferably have a width of 210 mm to 270 mm in consideration of heat radiation at opposite edges.

Figure 11:
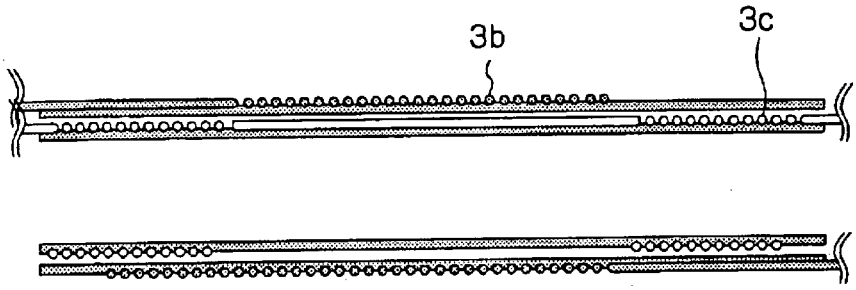

In the illustrative embodiment, the gap between the coil wound round the inner bobbin 6*b* and the core of the heat roller is greater than the gap between the coil wound round the outer bobbin 6*a* and the core, lowering the heating efficiency. In light of this, as shown in FIG. 11, a spiral groove is formed in each of the bobbins 6*a* and 6*b*. The coils each are wound along a particular spiral groove. This successfully brings both of the coils closer to the heat roller and therefore enhances heating efficiency accordingly.

Figure 12A:
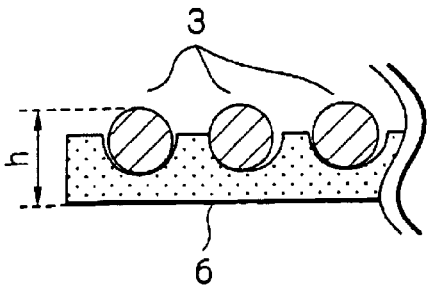
FIG. 12A shows how a coil is wound when a bobbin included in the illustrative embodiment is formed with a groove.
Figure 12B:
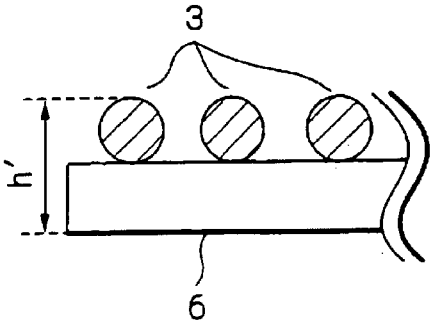
FIG. 12B shows how a coil is wound when the groove is absent.

FIGS. 12A and 12B respectively show the coil 3 wound round the bobbin 6 with the spiral groove and the coil 3 wound round the bobbin 6 without the spiral groove. As shown, the coil 3 on the bobbin 6 with the spiral groove has a height h smaller than the height h' of the coil 3 on the bobbin 6 without the spiral groove and is therefore closer to the core of the heat roller. If desired, the spiral groove may be assigned to only part of the coil 3. The inner bobbin, in particular, may not be formed with the spiral groove in order to bring the associated coil further closer to the core of the heat roller.

As stated above, the illustrative embodiment has a plurality of bobbins assembled in a telescopic manner, facilitating the production of the individual coil. Even when one coil snaps, only the snapped coil should be replaced.

Further, the coil wound round the outer bobbin is closer to the core of the heat roller than the coil wound round the inner bobbin. By using the coil on the outer bobbin as a main coil, it is possible to enhance the efficient operation of the fixing device. In addition, by assigning one coil to the main sheet passing range and assigning the other coil to the auxiliary sheet passing range, it is possible to efficiently fix a toner image without regard to the sheet size.

Moreover, the spiral groove formed in the bobbin reduces the height of the coil received therein and therefore the gap between the coil and the heat roller. This desirably enhances heating efficiency.

Figure 13:
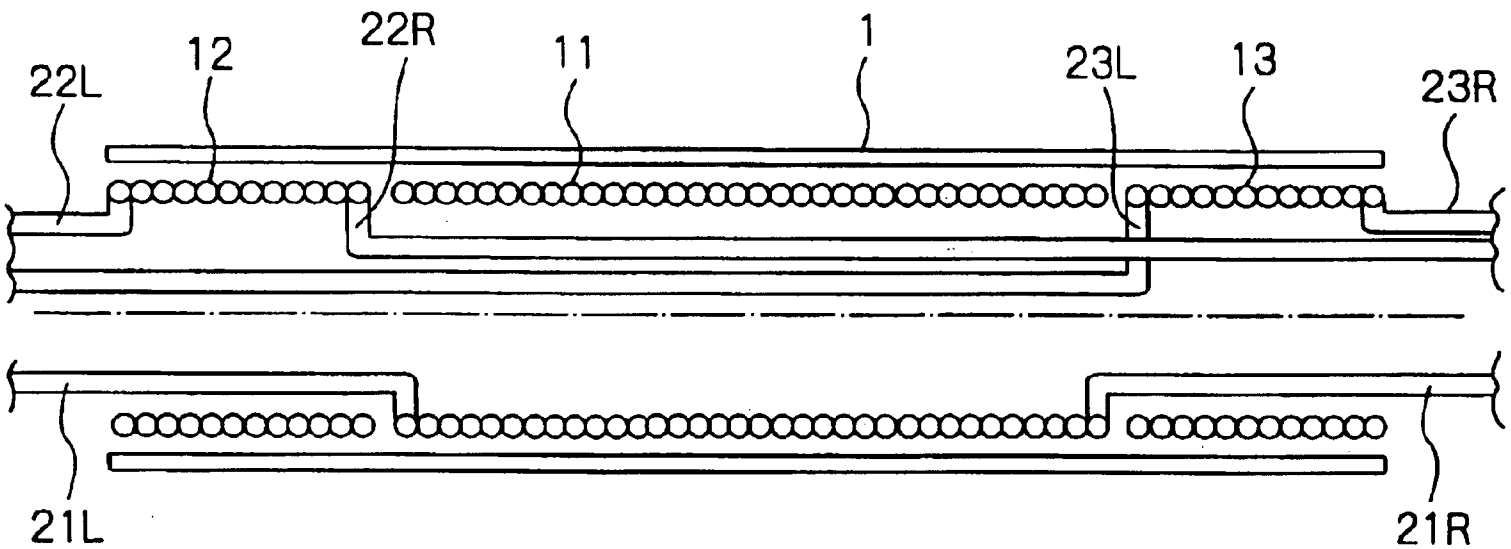
FIG. 13 is a section showing a heat roller to which an alternative embodiment of the induction heating coil of the present invention is applied.

Reference will be made to FIG. 13 for describing an alternative embodiment of the present invention. This embodiment is directed toward the second object stated earlier. As shown, the heat roller 1 includes a main coil 11 and two auxiliary coils 12 and 13. The main coil 11 and auxiliary coils 12 and 13 respectively have right leads 21R, 22R and 23R and left leads 21L, 22L and 23L. The right and left leads 21R and 21L of the main coil 11 are connected to a coil drive circuit, not shown, by being laid inside of the auxiliary coils 13 and 12, respectively. The left lead 22L of the auxiliary coil 12 and the right lead 23R of the auxiliary coil 13, which are positioned at opposite ends, are directly connected to the coil drive circuit. The right lead 22R of the auxiliary coil 12 and the left lead 23L of the auxiliary coil 13 are interconnected at the inside of the main coil 11.

In the illustrative embodiment, the leads 21R and 21L of the main coil 11 and the leads 22R and 23L of the auxiliary coils, respectively, each are connected to another coil or to the coil drive circuit over the immediately adjoining coil. At this instant, such leads each are laid inside of the adjoining coil. Therefore, a space that insures insulation without lowering heating efficiency can be secured between the heat roller 1 and the coils and leads. In addition, the space inside of the coils is effectively used to make the entire fixing device compact.

If desired, the leads 21R, 21L, 22R and 23L, each of which is laid inside of the adjoining coil, may be protected from breakdown by an organic insulator implemented as a tube or a tape for a safety purpose.

Figure 14:
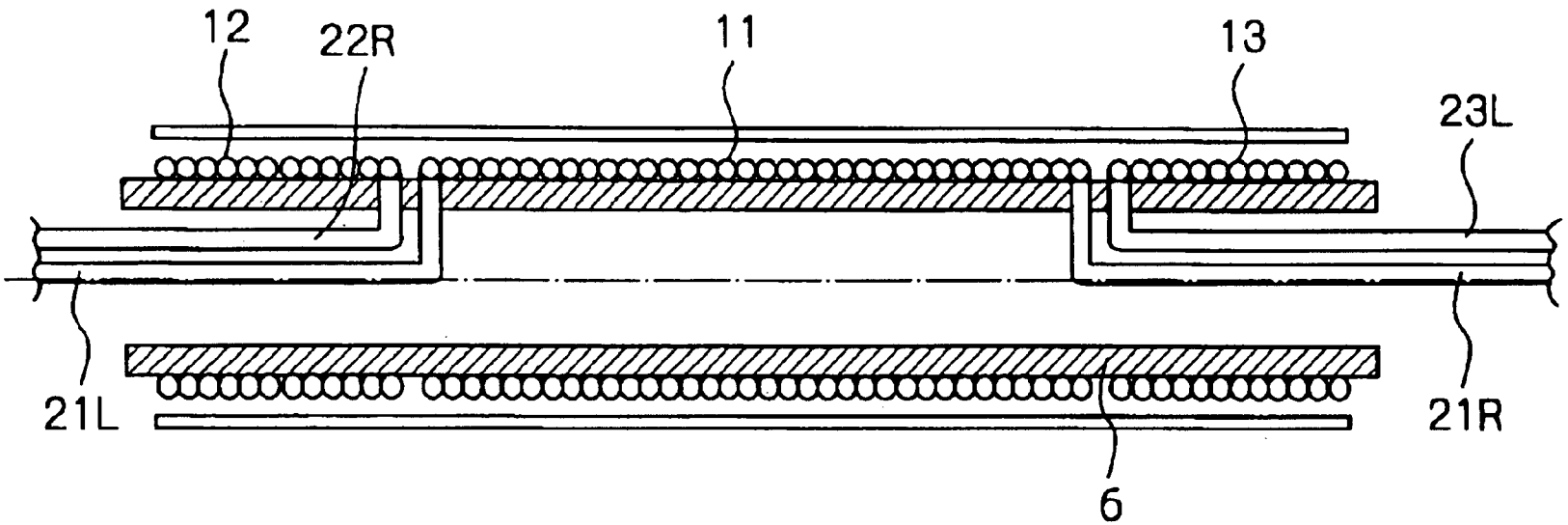
FIG. 14 is a section showing a modification of the alternative embodiment.

FIG. 14 shows a modification of the illustrative embodiment. As shown, the main coil 11 and auxiliary coils 12 and 13 are wound round a hollow cylindrical bobbin 6, which is formed of a nonconductive material. The right lead 22R of the auxiliary coil 12 and the left lead 23L of the auxiliary coil 13 are not interconnected, but are connected to the coil drive circuit by being laid inside of the respective coils. The leads 21R and 21L of the main coil 11 and the leads 22R and 23L of the auxiliary coils 12 and 13, respectively, are laid inside of the bobbin 6.

Figure 15:
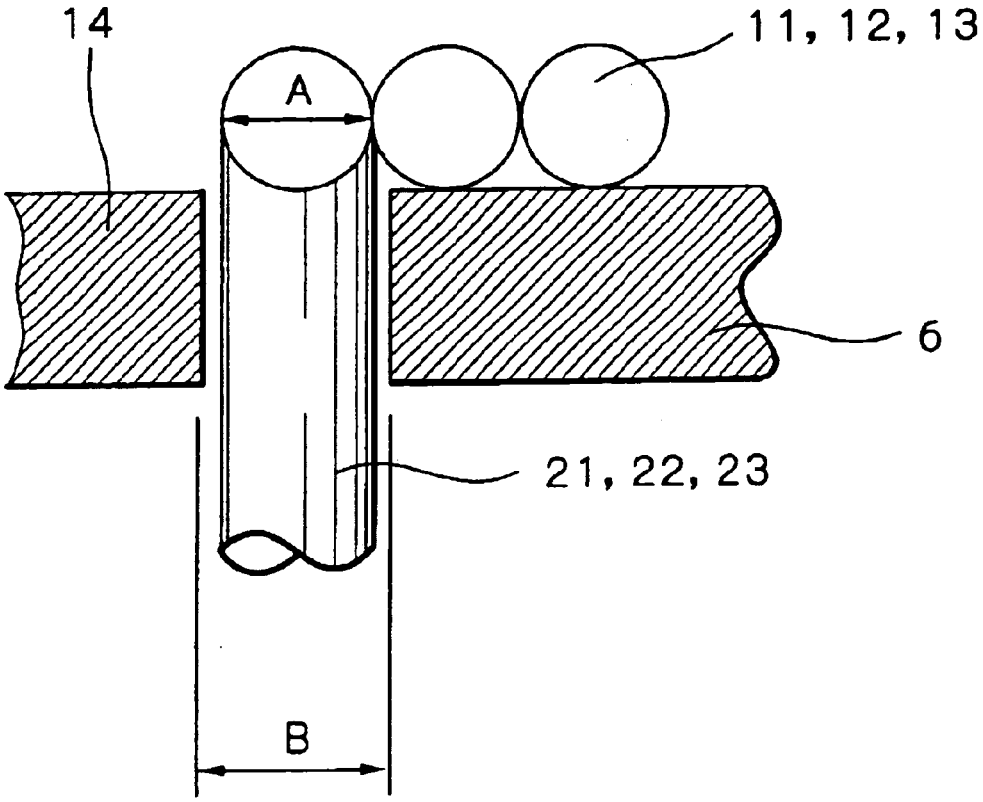
FIG. 15 is an enlarged view of the modification shown in FIG. 14.

As shown in FIG. 15, the bobbin 6 is formed with round holes 14 (only one is shown) for passing the leads 21R and 21L of the main coil 11 and the leads 22R and 23L of the auxiliary coils 12 and 13, respectively. The holes 14 each are positioned at the beginning or the end of a particular coil. Assuming that all the leads 21L, 21R, 22R and 23L have a diameter A, then the holes 14 have a diameter B greater than the diameter A.

The leads 21R, 21L, 22R and 23L are laid inside of the bobbin 6. Therefore, a space that insures insulation without lowering heating efficiency can be secured, as in the illustrative embodiment. Also, the space inside of the coils is effectively used to make the entire fixing device compact. Further, the coils 11 through 13 are wound round the bobbin 6 formed of a nonconductive material. The nonconductive material intervening between the leads 21R, 21L, 22R and 23L and the coils protects the coils or an inverter circuit from damage ascribable to, e.g., short-circuiting. Moreover, the round holes 14 formed in the bobbin 14 allow the coils 11 through 13 to be accurately positioned. In addition, the holes 14 greater in diameter than the leads facilitate wiring work and reduce the production cost of the induction heating coil.

Figures 16A, 16B:
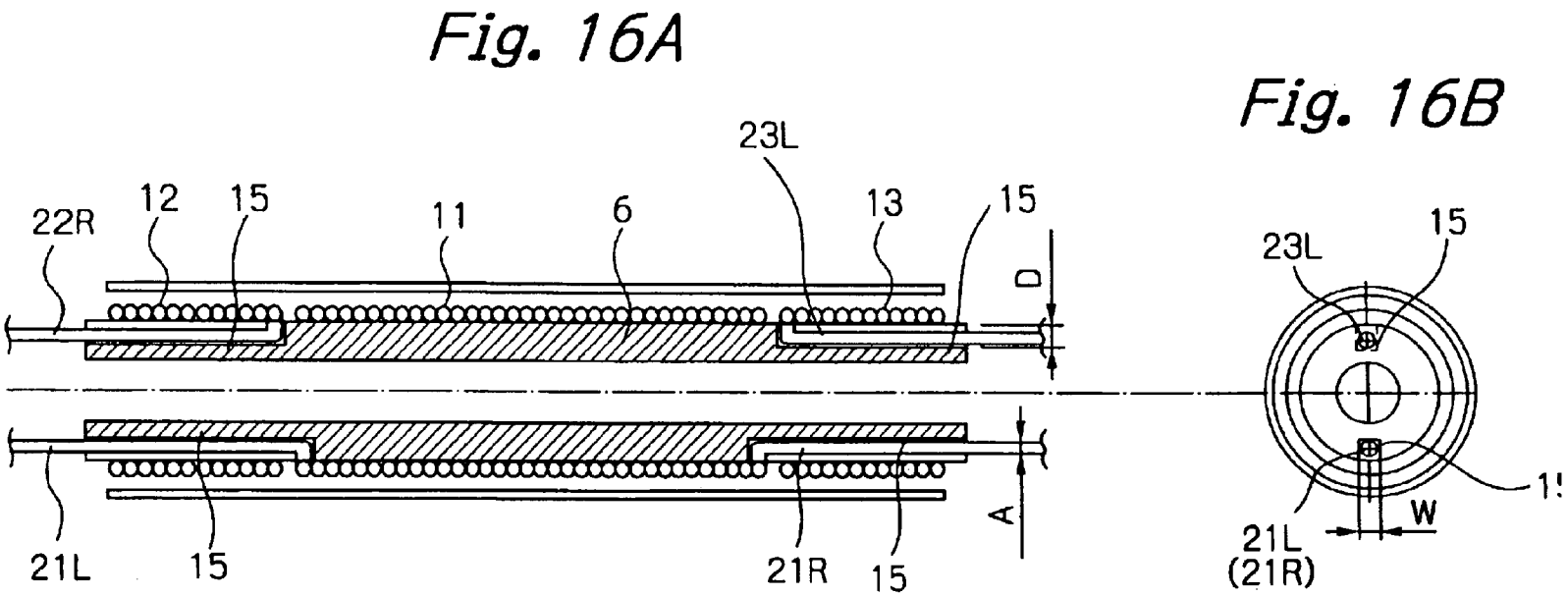
FIG. 16A is a front view showing another modification of the alternative embodiment.
FIG. 16B is a side elevation showing the modification of FIG. 16A.

FIGS. 16A and 16B show another modification of the illustrative embodiment. As shown, the coils 11 through 13 are again wound round the hollow cylindrical bobbin 6 formed of a nonconductive material. In this modification, the leads 21R and 21R of the main coil 11 and the leads 22R and 23L of the auxiliary coils 12 and 13, respectively, are connected to the coil drive circuit by being laid in channels 15 formed in the bobbin 6. The channels 15 have a depth D and a width W greater than the diameter A of the leads 21 through 23, and each extends from the end of the associated coil to the end of the bobbin 6.

As stated above, the leads 21R, 21L, 22R and 23L each are laid in a particular groove 15 formed in the bobbin 6. Therefore, a space that insures insulation without lowering heating efficiency can be secured, as in the illustrative embodiment. Also, the space inside of the coils is effectively used to make the entire heating device compact.

Figures 17A, 17B:
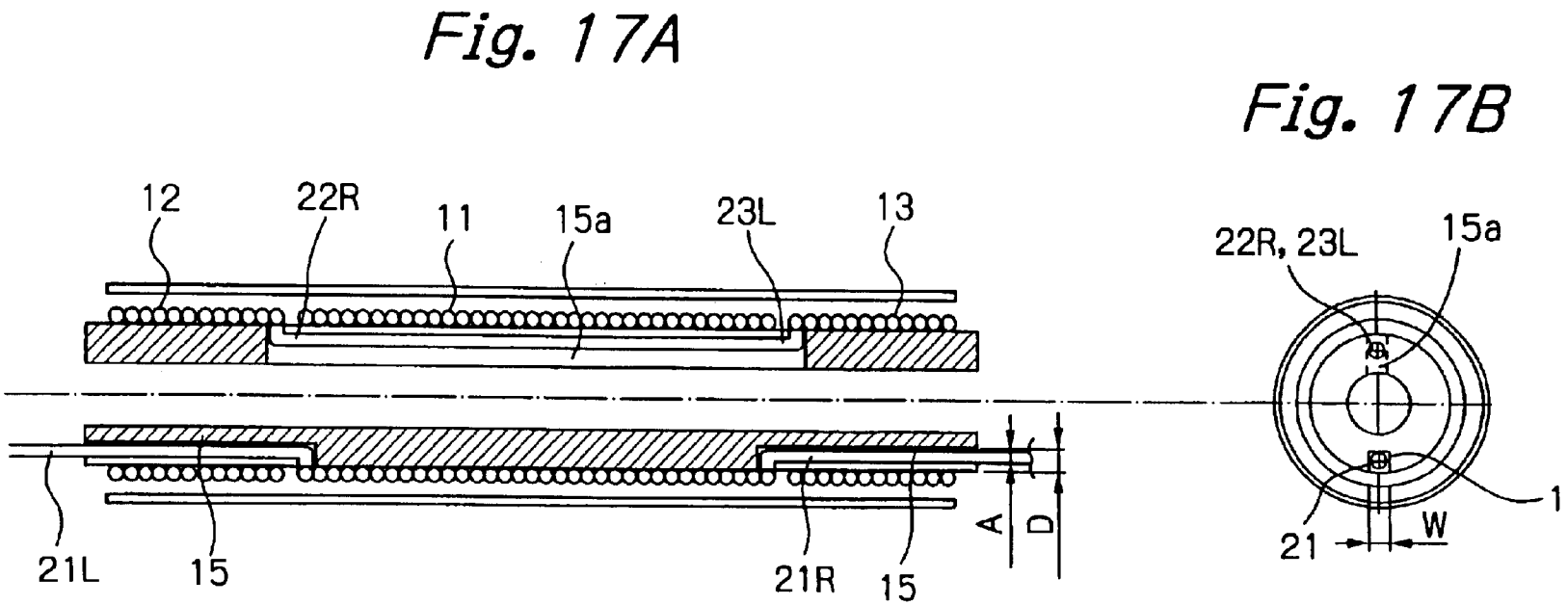
FIG. 17A is a sectional front view showing another modification of the alternative embodiment.
FIG. 17B is a side elevation showing the modification of FIG. 17A.

FIGS. 17A and 17B show still another modification of the illustrative embodiment similar to the modification of FIGS. 16A and 16B. As shown, the right lead 22R of the auxiliary coil 12 and the left lead 23L of the auxiliary coil 13 are interconnected and laid in a channel 15*a* implemented as an elongate slot. Again, the channel 15 has a width W greater than the diameter A of the leads 22R and 23L.

Figure 18:
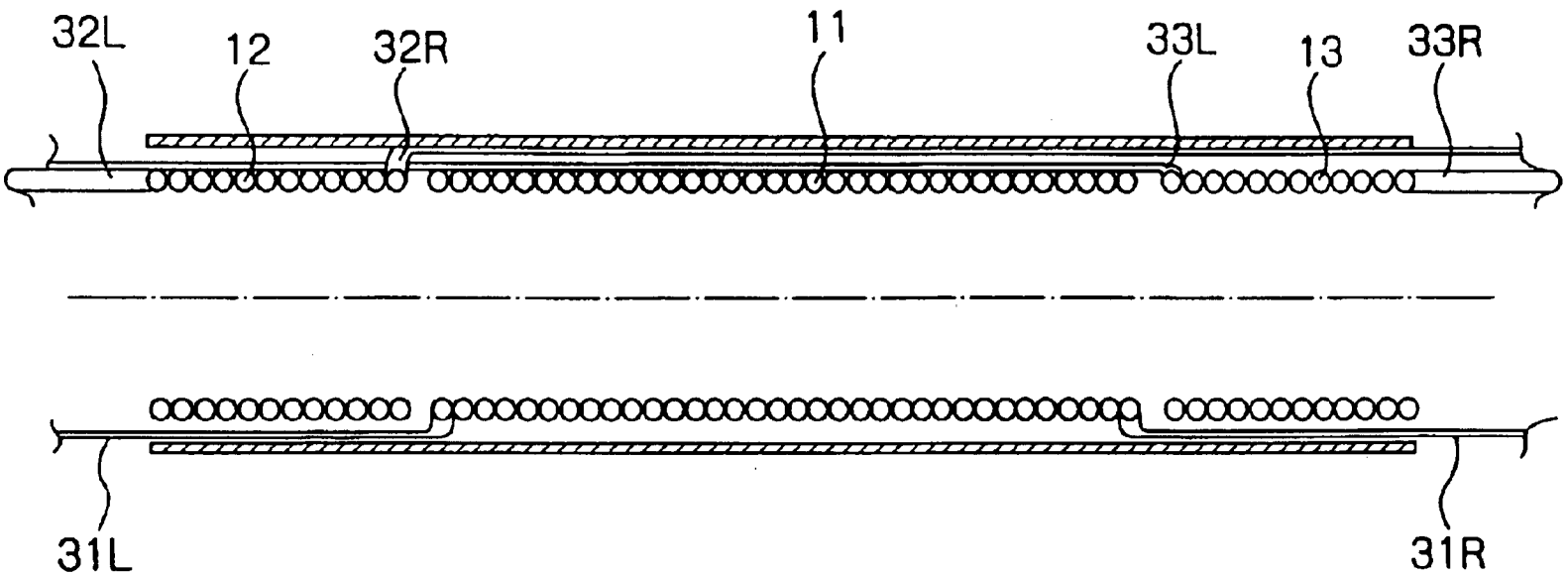
FIG. 18 is a sectional front view showing another modification of the illustrative embodiment.

FIG. 18 shows a further modification of the illustrative embodiment. As shown, the main coil 11 has a right lead 31R and a left lead 31L each having a flat configuration. Likewise, the auxiliary coils 12 and 13 respectively have flat right leads 32R and 33R and flat left leads 32R and 33L. The leads 31R and 31L of the main coil 11 are connected to the coil drive circuit over the auxiliary coils 13 and 12, respectively. The left lead 32L of the auxiliary coil 12 and the right lead 33R of the auxiliary coil 13, which are positioned at opposite ends, are directly connected to the coil drive circuit. Further, the right lead 32R of the coil 12 and the left lead 33L of the coil 13 are interconnected over the main coil 11. In this case, the leads 22R and 23L are interconnected over the main coil 11.

In this modification, too, the leads 31R and 31L of the main coil 11 and the leads 32R and 33L of the auxiliary coils, respectively, each are connected to another coil or to the coil drive circuit over the immediately adjoining coil. Because the leads are flat, a space that insures insulation without lowering heating efficiency can be secured between the heat roller 1 and the coils and leads. In addition, the space inside of the coils is effectively used to make the entire fixing device compact. Again, at least the leads 31R, 31L, 32R and 33L, each of which extends over the coils, may be protected from breakdown by an organic insulator implemented as a tube or a tape for a safety purpose. Further, the leads 32L and 33R that do not extend over any coil may not be flat.

Figure 19:
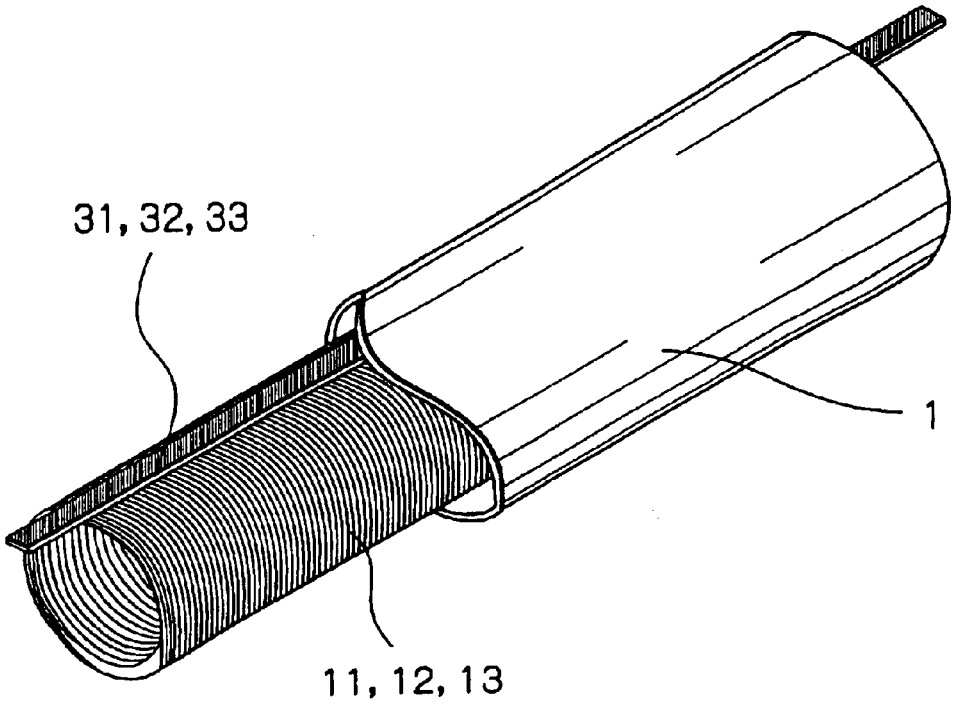
FIG. 19 is an isometric view showing a lead implemented by a litz wire.
Figure 20:
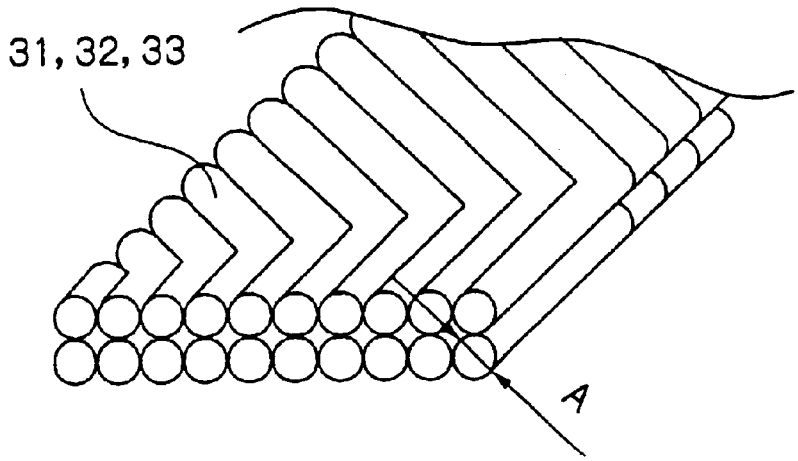
FIG. 20 is an enlarged isometric view of the lead shown in FIG. 19.

FIGS. 19 and 20 show a litz wire applicable to the flat leads 31 through 33. The leads 31 through 33 implemented by litz wires bring about a minimum of increase in high-frequency resistance ascribable to a skin effect when high-frequency current flows through the induction heating coil.

Figure 21:
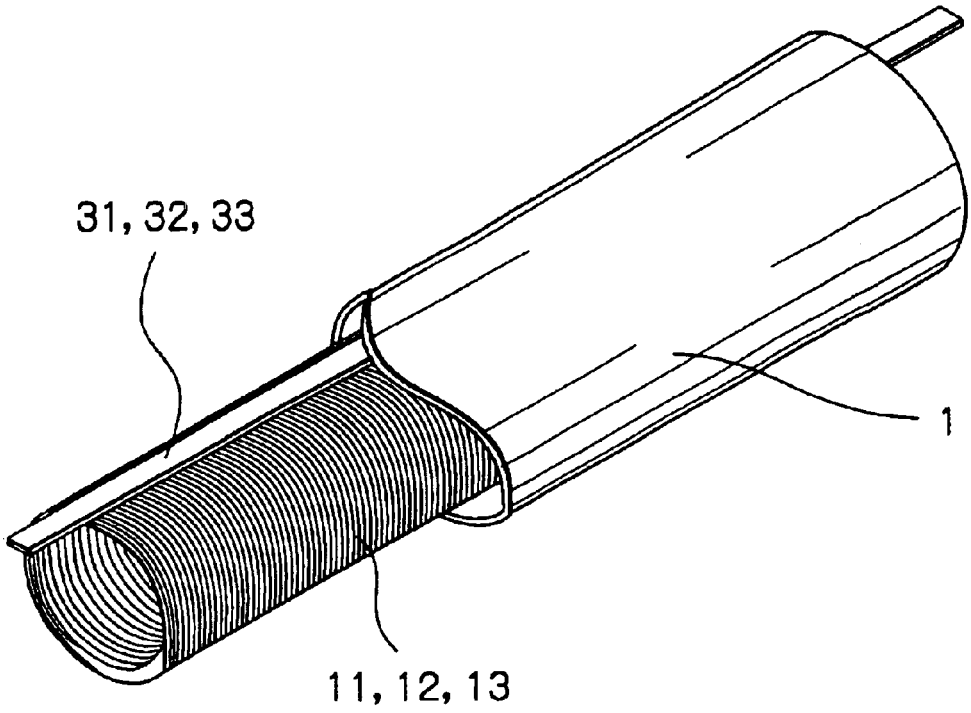
FIG. 21 is a perspective view showing a lead implemented by a thin, flat sheet.
Figure 22:
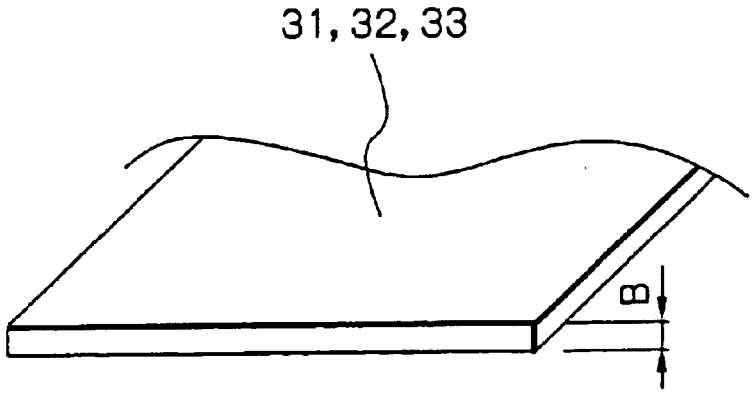
FIG. 22 is an enlarged view of the lead shown in FIG. 21.

FIGS. 21 and 22 show a conductive flat sheet also applicable to the flat leads 31 through 33. As shown, the leads 31 through 33 are implemented by conductive flat sheets while the coils 11 through 13 are implemented by litz wires. Alternatively, not only the leads 31 through 33 but also the coils 11 through 13 may be implemented by flat sheets. The leads 31 through 33 implemented by flat sheets also bring about a minimum of increase in high-frequency resistance ascribable to a skin effect when high-frequency current flows through the induction heating coil.

The embodiment and its modifications shown described above with reference to FIGS. 13 through 22 are applicable to a fixing device of the type passing a paper sheet by using the center as a reference. The heat roller 1 has a width great enough to fix an image over the lateral width of an A4 paper sheet (width A4Y hereinafter). The main coil 11 and auxiliary coils 12 and 13 are disposed in the heat roller 1. The main coil 11 is positioned at the center and longer than the auxiliary coils 12 and 13. The main coil 11 has a length equal to or slightly greater than the longitudinal width of an A4 paper sheet (width A4T hereinafter) and is assigned to the main range that an A4 paper sheet having the width A4T passes. The auxiliary coils 12 and 13 are contiguous with opposite ends of the main coil 11. The overall length of the three coils 11 through 13 is equal to or slightly greater than the width A4Y so as to fix an image over the opposite auxiliary ranges.

The above-described fixing device may be so constructed as to feed current only to the coil or coils that cover the sheet passing width. For example, to fix an image carried on a paper sheet having the width A4T or A4Y, current is fed only to the main coil 11 or to both of the main coil 11 and auxiliary coils 12 and 13. Therefore, even when a paper sheet with the width A4Y is fed after the continuous feed of paper sheets with the width A4T, a temperature difference does not occur on the surface of the heat roller 1. This, coupled with the fact that the end portions of the heat roller 1 are not heated to an unexpected temperature, frees an image from a difference in gloss and obviates defective fixation ascribable to the excessively high temperature of the end portions. If the hollow bobbin 6 is open at opposite ends thereof, then air can be sent into the bobbin 6 in order to cool off the coils 11 through 13. This makes it needless to use coils each having an insulation layer highly resistant to heat.

Figure 23:
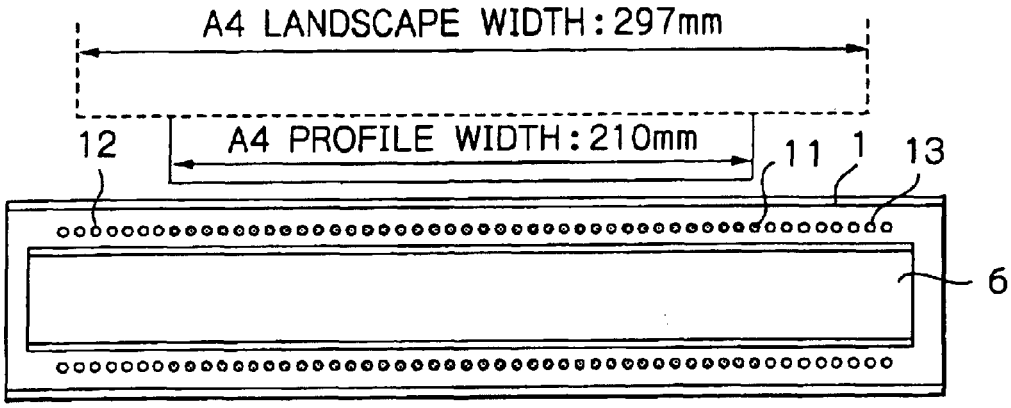
FIGS. 23 and 24 are sections each showing another modification of the alternative embodiment.

FIG. 23 shows the fixing device applicable to an image forming apparatus of the type feeding a paper sheet by using one edge as a reference. As shown, the fixing device includes the main coil 11 having a width equal to or slightly greater than the width A4T and the auxiliary coil 12 contiguous with the main coil 11. The auxiliary coil 12 has a width covering the width A4Y when combined with the width of the main coil 11. The two coils 11 and 12 are wound round the bobbin 6 whose axis is substantially coincident with the axis of the heat roller 1. The ends of the coils 11 and 12 are connected to a control circuit not shown.

To fix an image on a paper sheet with the width A4T, current is fed only to the main coil while, to fix an image on a paper sheet with the width A4Y, current is fed to both of the main coil 11 and auxiliary coil 12. This allows the fixing device to easily, selectively deal with the widths A4T and A4Y often used.

Figure 24:
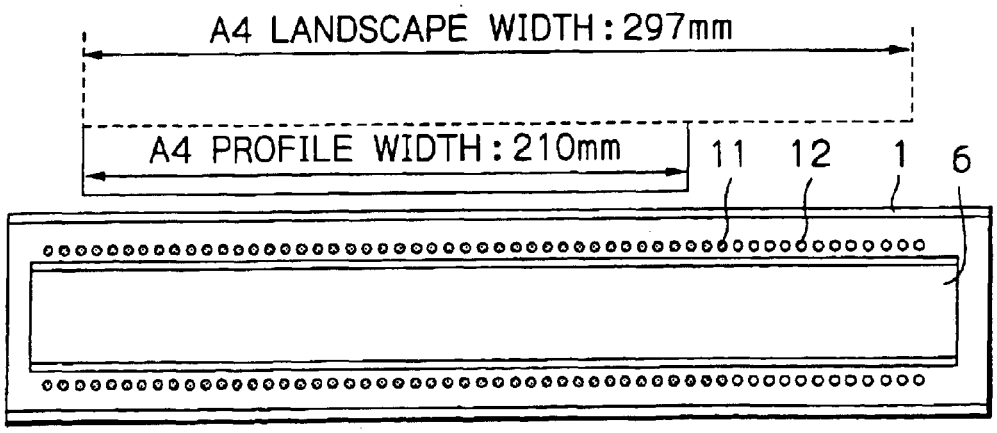
Figure 25A:
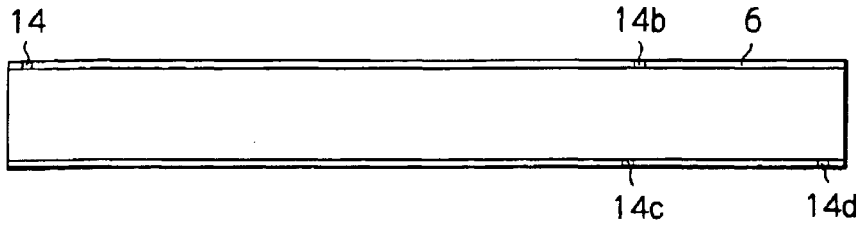
FIGS. 25A through 25C are views demonstrating a procedure for producing an induction heating coil shown in FIG. 24.
Figure 25B:
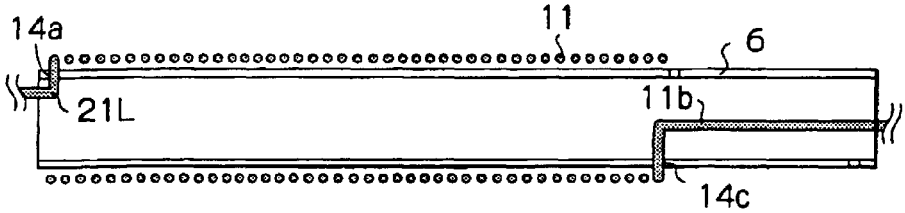
Figure 25C:
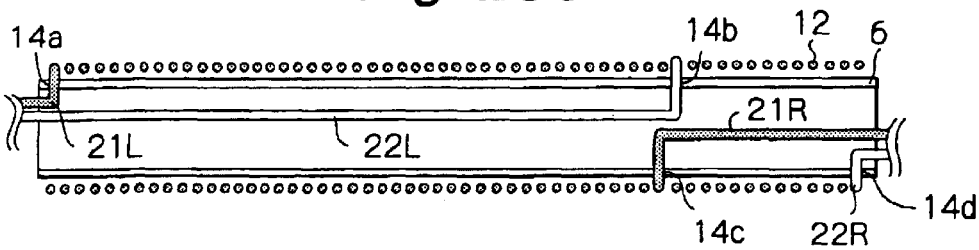

A specific procedure for producing the induction heating coil shown in FIG. 24 will be described with reference to FIGS. 25A through 25C. As shown in FIG. 25A, the bobbin 6 is formed with holes 14*a* 14*b*, 14*c* and 14*d* at opposite end portions and portions between the main coil 11 and the auxiliary coil 12. As shown in FIG. 25B, the main coil 11 is wound round the bobbin 6 with its right lead 21R and left lead 21L connected to the coil drive circuit via the holes 14*c* and 14*a*, respectively. Subsequently, as shown in FIG. 25C, the auxiliary coil 12 is wound round the bobbin 6 with its right lead 22R and left lead 22L connected to the coil drive circuit via the holes 14*d* and 14*b*, respectively.

In the above procedure, it is noteworthy that the leads 21R and 21L of the main coil 11 and the leads 22R and 22L of the auxiliary coil 12 each are laid inside of the bobbin 6. Such leads therefore do not increase the gap between the heat roller 1 and the coils 11 and 12, so that the coil assembly is comparable in efficiency with a single coil.

Figure 26:
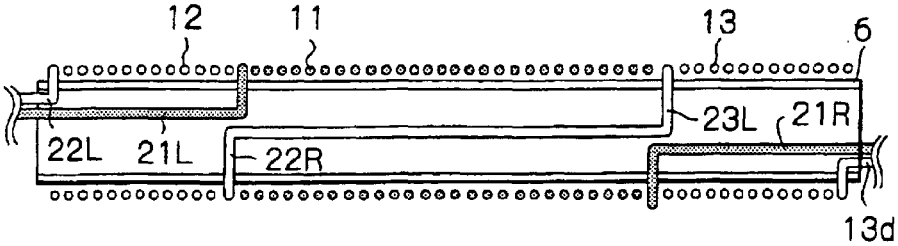
FIG. 26 is a view showing leads laid in a specific pattern.

The main coil 11 and auxiliary coils 12 and 13 shown in FIG. 23 are synchronous to each other with respect to the current feed timing. In this case, as shown in FIG. 26, the right lead 22R of the auxiliary coil 12 and the left lead 23L of the auxiliary coil 13 are interconnected within the bobbin 6. The left lead 22L of the auxiliary coil 12, the right lead 23R of the auxiliary coil 13 and the right and left leads 11*b* and 11*a* of the main coil 11 are connected to a control circuit not shown via the inside of the bobbin 6.

The leads 21 through 23 of the coils 11 through 13 laid inside the bobbin 6 do not increase the gap between the heat roller 1 and the coils 11 through 13. Further, despite the presence of three coils 11 through 13, only four leads to be connected to the control circuit suffice as in FIGS. 25A through 25C.

Figure 27:
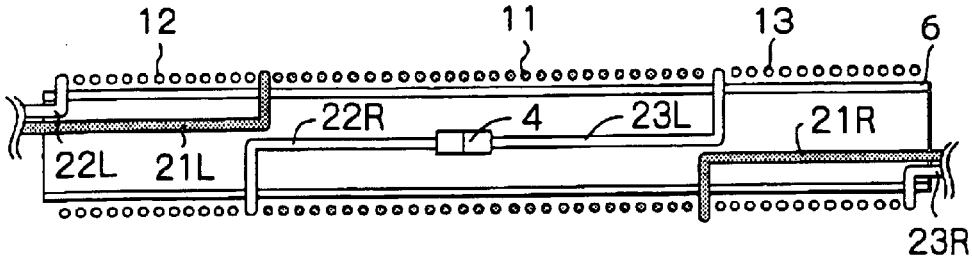
FIG. 27 is a view showing a modification of the pattern of FIG. 26.

The induction heating coil sometimes snaps due to one cause or another. In FIG. 25, for example, should either one of the auxiliary coils 12 and 13 snap, the coils 12 and 13 both should be replaced. In light of this, as shown in FIG. 27, the auxiliary coils 12 and 13 are connected to each other by a removable connector or connecting means 4.

Figure 28:
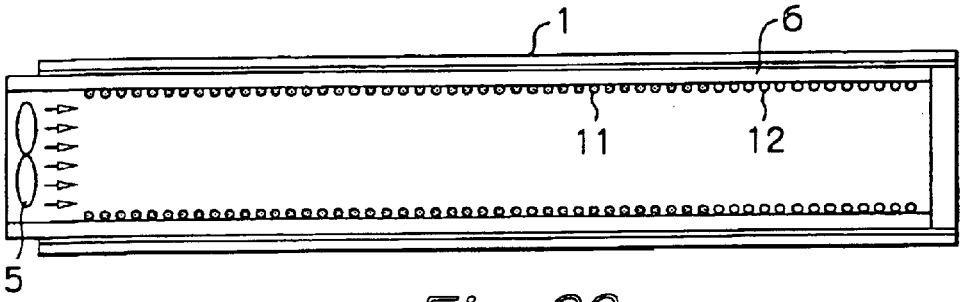
FIG. 28 is a section showing still another modification of the illustrative embodiment.

As shown in FIG. 28, the coils 11 and 12 may be arranged on the inner periphery of the bobbin 6. In such a case, when a fan 5 sends air into the bobbin 6 for cooling the coils 11 and 12, the coils 11 and 12 can be cooled off far more efficiently than when arranged on the outer periphery of the bobbin 6. This promotes the use of inexpensive coils each including an insulation layer whose heat resistance is relatively low.

Figure 29:
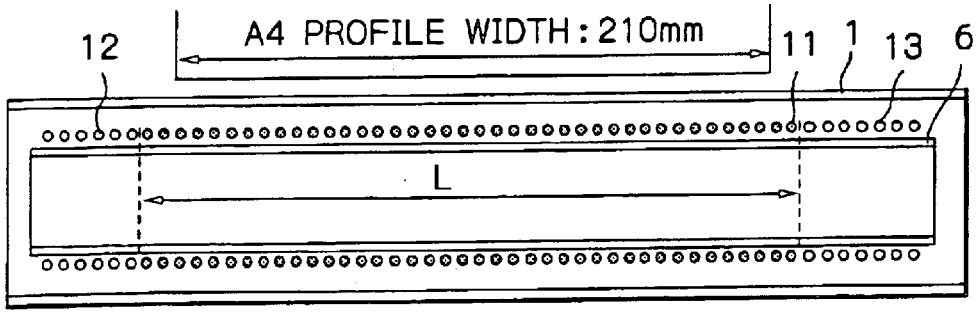
FIG. 29 is a view showing a width over which a main coil is wound in the modification of FIG. 23.

As shown in FIG. 29, the main coil 11 between the auxiliary coils 12 and 13 has a length L that is equal to or greater than the width A4T (210 mm). However, if the length L is too great, then the coil 11 will wastefully heat the ranges that do not contribute to fixation. Therefore, to save energy, the length L is selected to be between 210 mm and 270 mm. In this condition, even when a paper sheet with the width A4T, which is often used in an apparatus whose maximum sheet passing width is size A3, is fed, the main coil 11 with the length L greater than the width A4T reduces temperature elevation at opposite ends thereof and therefore substantially obviates defective fixation.

Figure 30:
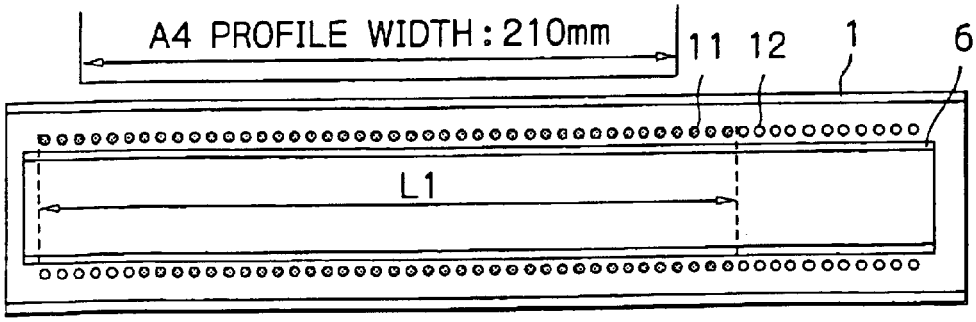
FIG. 30 is a view showing a width over which a main coil is wound in the modification of FIG. 24.

As shown in FIG. 30, the main coil 11 positioned at the end of the bobbin 6 has a length L1 that is also equal to or greater than the width A4T (210 mm). Again, if the length L1 is too great, then the coil 11 will wastefully heat the range that does not contribute to fixation. Therefore, to save energy, the length L1 is also selected to be between 210 mm and 270 mm. In this condition, even when a paper sheet with the width A4T, which is often used in an apparatus whose maximum sheet passing width is size A3, is fed, the main coil 11 with the length L1 greater than the width A4T reduces temperature elevation at opposite ends thereof and therefore substantially obviates defective fixation.

In any case, the illustrative embodiment and its modifications reduce the irregular temperature distribution of the heat roller and thereby insure attractive images. In addition, the induction heating coil can be cooled off and can therefore be implemented by relatively inexpensive coils, which contribute to the cost reduction of the entire fixing device.

Figure 31:
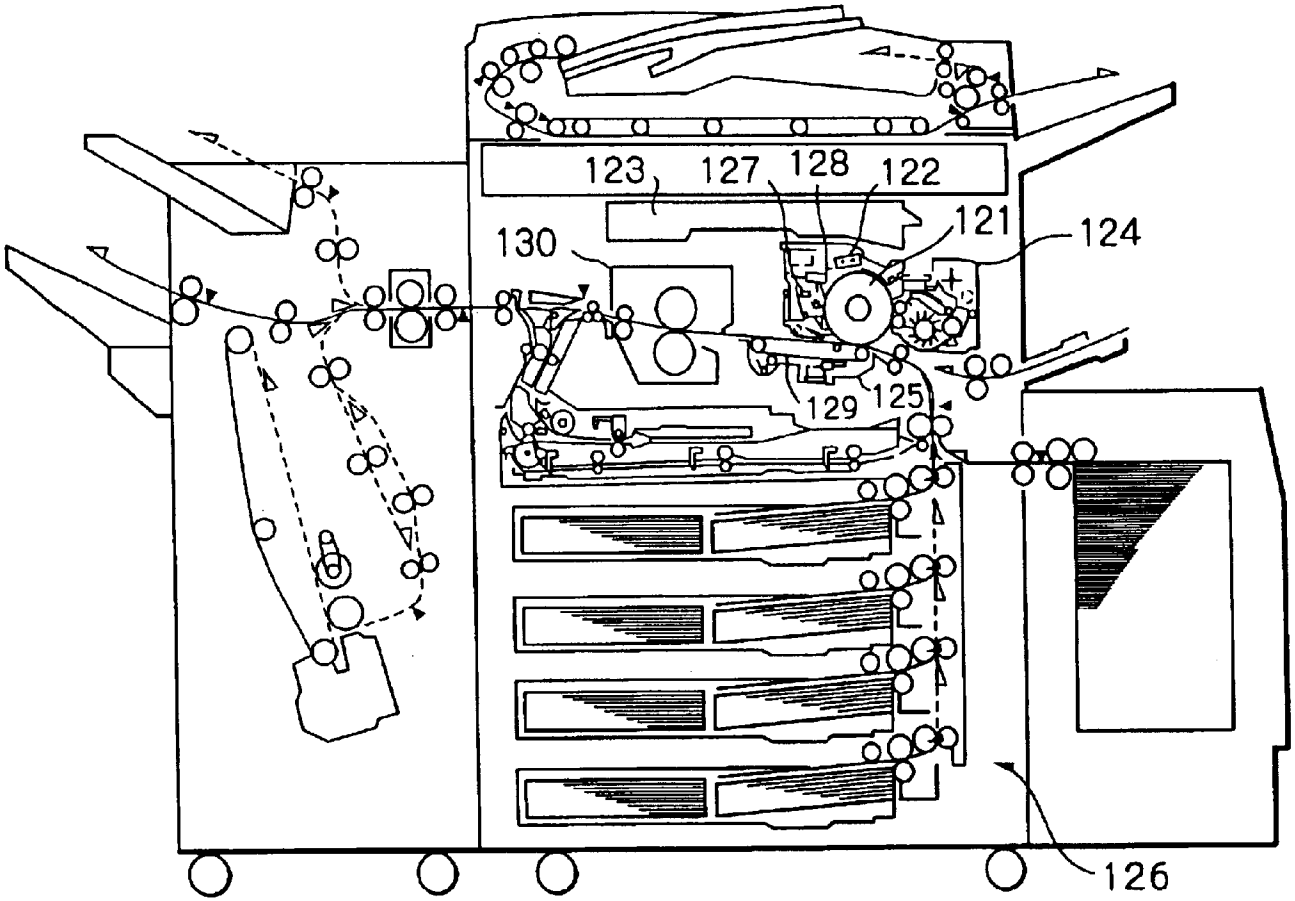
FIG. 31 is a view showing the general construction of an image forming apparatus to which the alternative embodiment is applied.

Reference will be made to FIG. 31 for describing an image forming apparatus to which the illustrative embodiment is applied. As for basic construction, the image forming apparatus shown in FIG. 31 is identical with the conventional image forming apparatus. As shown, the image forming apparatus includes a photoconductive drum or image carrier 121. Arranged around the drum 121 are a charger 122, a laser beam 123 representative of scanning optics, a developing device 124, an image transferring device 125, a cleaning device 127, and a discharger 128.

The charger 122 uniformly charges the surface of the drum 121. The laser beam 123 scans the charged surface of the drum 121 to thereby form a latent image on the drum 121. The developing device 124 deposits charged toner on the latent image to thereby produce a corresponding toner image. The image transferring device 125 transfers the toner image from the drum 121 to a paper sheet or similar recording medium. The cleaning device 127 removes the toner left on the drum 121 after the image transfer. The discharger 128 discharges potential left on the drum 121 for thereby preparing the drum 121 for another image formation.

Assume that the image forming apparatus forms an image by negative-to-positive development. Then, after the charger 122 has uniformly charged the surface of the drum 121, the laser beam 123 forms a latent image on the drum 121. The developing device 124 develops the latent image to thereby form a corresponding toner image. The image transferring device 125, which includes a belt 129, transfers the toner image from the drum 121 to a paper sheet or similar recording medium, not shown, fed from a sheet bank 126 or an extra tray. The sheet bank 126 is arranged in the lower portion of the apparatus and includes a tandem tray, a universal tray, and a fixed tray. At this instant, a peeler peels off the paper sheet electrostatically adhering to the drum 121. A fixing device 130 includes the coils 11 through 13 and fixes the toner image on the paper sheet. The cleaning device 127 removes and collects the toner left on the drum 121 without being transferred to the paper sheet. Subsequently, the discharger 128 discharges potential left on the drum 121.

Figure 32:
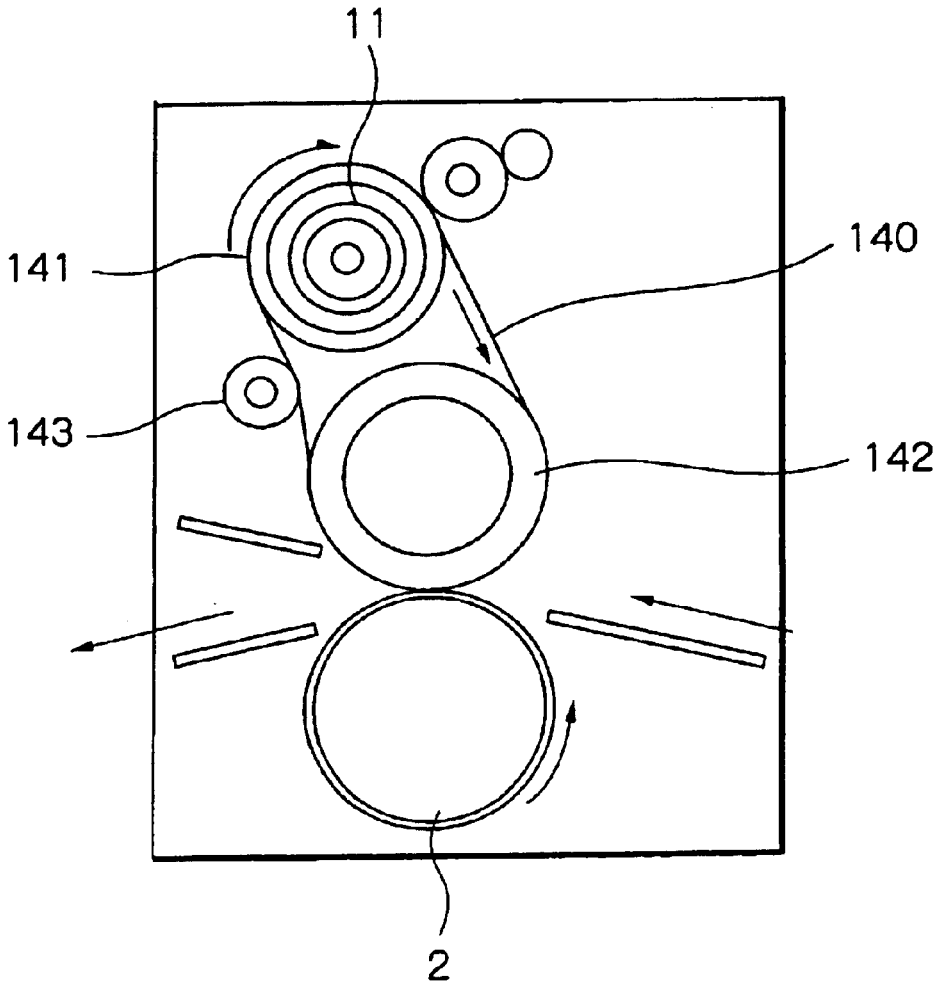
FIG. 32 is a view showing a specific configuration of a fixing device using a belt in place of the induction heating coil.

The coils 11 through 13 of the illustrative embodiment and its modifications are similarly applicable to a fixing device of the type using a belt in place of rollers. As shown in FIG. 32 specifically, the fixing device of the type described includes a belt 140 passed over a heat roller 141 accommodating the coils 11 through 13 and a fixing roller 142. The press roller 2 is pressed against the fixing roller 142. A tension roller 143 applies tension to the belt 140. In an alternative configuration, a press roller is substituted for the tension roller 143 and conveys a paper sheet in cooperation with a belt. In such a configuration, the coils 11 through 13 may be positioned at the side opposite to the press roller with respect to the belt.

As stated above, the illustrative embodiment and its modification have various advantages, as enumerated below.

(1) A space that insures insulation without lowering heating efficiency can be secured. In addition, the space inside of the coils is effectively used to make the entire fixing device compact.

(2) The nonconductive material intervening between the leads and the coils protect the coils or an inverter circuit from damage ascribable to, e.g., short-circuiting. Moreover, the round holes formed in the bobbin allow the coils to be accurately positioned.

(3) The holes, which extend toward the axis of the nonconductive bobbin, allow the coils to be surely positioned. In addition, the holes are greater in diameter than leads and therefore facilitate wiring work and reduce the production cost of the induction heating coil. This is also true when the holes are replaced with the channels.

(4) At least one coil is connected to another coil by the removable connecting means and can therefore be easily replaced.

(5) The space between the coils and the heat roller is effectively used to make the entire fixing device compact.

(6) There can be reduced the rise of high-frequency resistance ascribable to a skin effect when high-frequency current flows through the coils.

(7) The leads are rigid and thin and allow the coils to be brought closer to the heat roller in order to enhance thermal conversion efficiency.

(8) The thin, flat leads formed of a conductive material each have a cross-sectional area equal to or greater than the cross-sectional area of the lead implemented by a litz wire. This makes the resistance loss of the coils as small as that of a litz wire.

(9) The thin, flat leads formed of a conductive material each have a thickness equal to or smaller than that of a litz wire. This reduces the rise of high-frequency resistance ascribable to a skin effect when high-frequency current flows through the coils as effectively as when the leads are implemented by litz wires.

(10) The main coil covers the main range of the heat roller, which a paper sheet having a size smaller than the maximum sheet passing width passes. The auxiliary coil or coils cover the auxiliary ranges of the heat roller outside of the main range. Therefore, even after a paper sheet with a relatively great width is passed just after the passage of a paper sheet with a relatively small width, an attractive image is achievable because of a minimum of irregularity in temperature distribution. In addition, such coils can be selectively used.

(11) Opposite ends of the main coil are coincident with opposite ends of the main range of the heat roller or extend slightly outward of the main range. This reduces the fall of temperature at opposite ends and therefore insures desirable images.

(12) The fixing device with the coils reduces irregularity in the temperature distribution of the heat roller and produces attractive images. In addition, the coils can be cooled off and can therefore be implemented by relatively inexpensive coils, which contribute to the cost reduction of the entire fixing device.

Figure 33A:
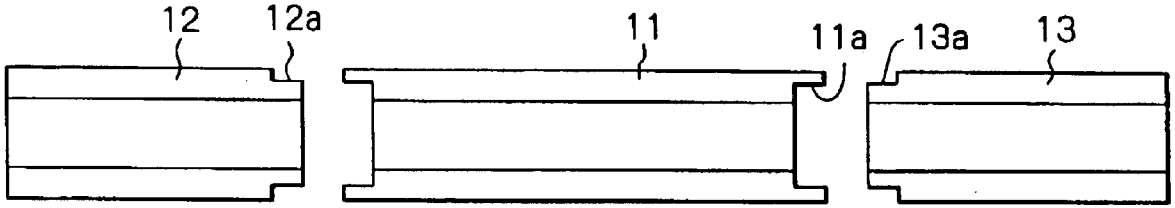
FIGS. 33A through 33C are views demonstrating a procedure for producing an induction heating coil representative of another alternative embodiment of the present invention.

A further alternative embodiment of the present invention will be described with reference to FIGS. 33A through 33C. This embodiment is directed toward the third object stated earlier. As shown in FIG. 33A, the bobbin 6 is divided into a plurality of bobbin members, e.g., a main bobbin member 11 and auxiliary bobbin members 12 and 13 positioned at opposite sides of the main bobbin member 11. The main bobbin or center bobbin 11 is formed with recesses 11*a* at its opposite ends. The auxiliary bobbin members 12 and 13 are respectively formed with projections 12*a* and 13*a* at their one end. The recesses 11*a* and projections 12*a* and 13*a* are configured to mate with each other.

Figure 33B:
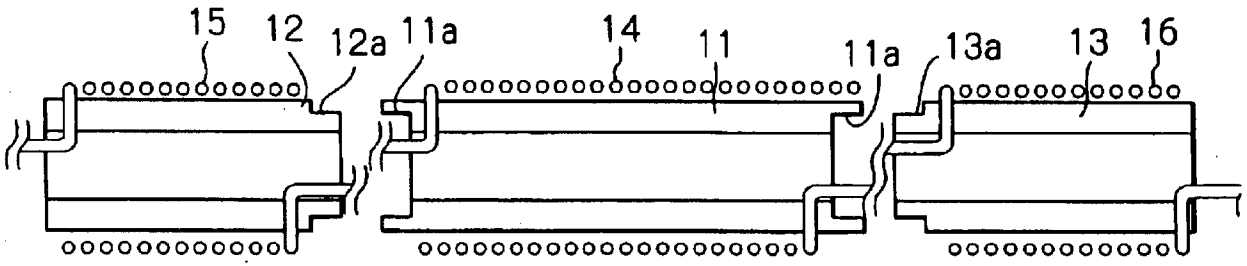
Figure 33C:
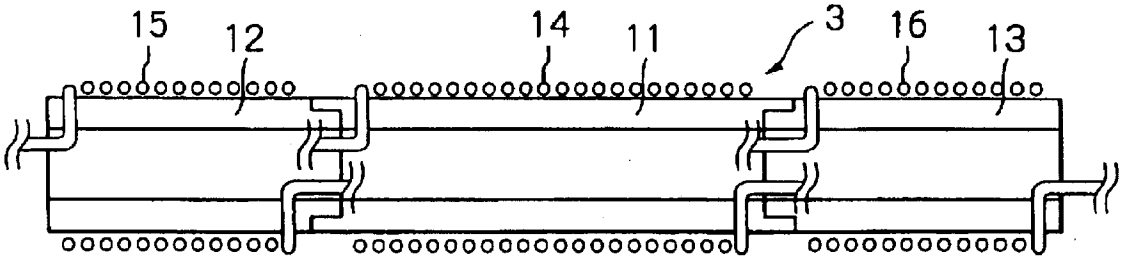

As shown in FIG. 33B, conductors 14, 15 and 16 are wound round the bobbin members 11, 12 and 13, respectively. The conductors 14 through 16 may be implemented by stranded wires, if desired. As shown in FIG. 33C, the bobbin members 12 and 13 with the conductors 15 and 16 are connected to the center bobbin member 11 with the projections 12*a* and 13*a* mating with the recesses 11*a*, completing an induction heating coil 3.

In the illustrative embodiment, the conductors 14 through 16 respectively wound round the separate bobbin members 11 through 13 beforehand each are short and easy to wound. When any one of the conductors 14 through 16 snaps, only the bobbin member with the snapped conductor should be replaced. The induction heating coil 3 is therefore easier to handle than the conventional induction heating coil and saves cost.

Figure 34:
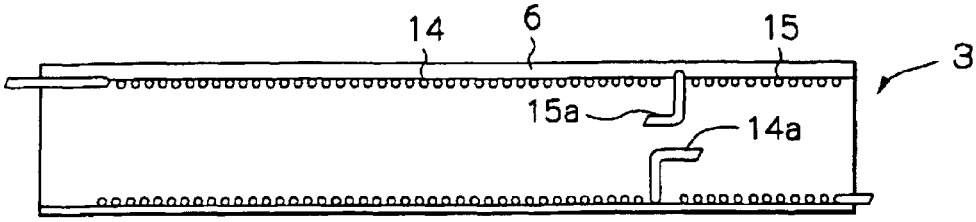
Fig. 34 PRIOR ART
FIG. 34 is a section showing another conventional induction heating coil.
Figure 35A:
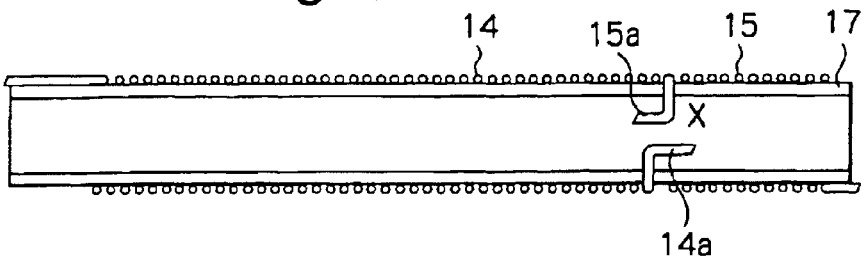
Fig. 35A PRIOR ART
FIGS. 35A and 35B are views for describing the problem of the induction heating coil shown in FIG. 34.
Figure 35B:
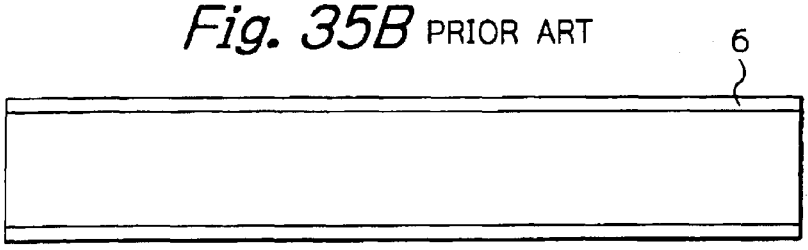
Fig. 35B PRIOR ART

FIG. 34 shows a conventional induction heating coil including a bobbin 6 and conductors 14 and 15 would on the inner periphery of the bobbin 6. Assume that a conventional method of production dealing with a single conductor is applied to the configuration shown in FIG. 34. Then, as shown in FIG. 35A, the conductors 14 and 15 are wound round a core 17. Subsequently, the conductors 14 and 15 wound on the core 17 are inserted into and adhered to the bobbin 6 shown in FIG. 35B. Thereafter, the core 17 is pulled out of the bobbin. At this instant, how the end portions 14*a* and 15*b* of the conductors 14 and 15, respectively, should be dealt with around a position X is the problem. Specifically, as shown in FIG. 35A, assume that the end portions 14*a* and 15*a* are simply passed through holes formed in the core 17 into the core 17. Then, it is difficult to pull out the core 17. Specifically, a single coil can be easily dealt with because its ends are positioned at the ends of a core. However, the above method is problematic when applied to the induction coil 3 having a plurality conductors.

Figure 36A:
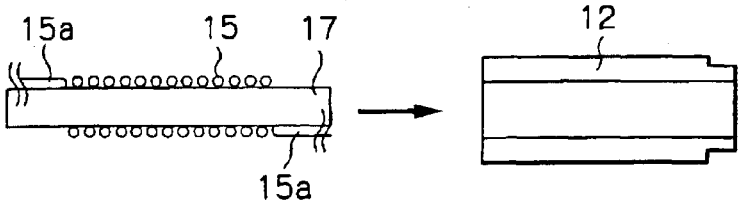
FIGS. 36A through 36C are views demonstrating a procedure for producing an induction heating coil in which coils are wound on the inner peripheries of bobbins.
Figure 36B:
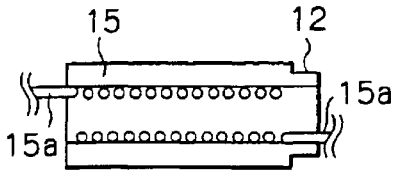
Figure 36C:
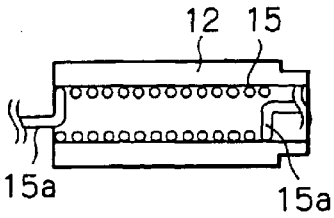
Figure 37:
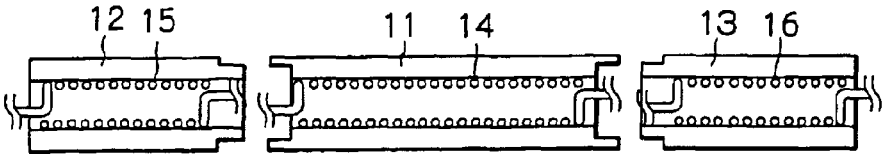
FIG. 37 shows the induction heating coil of the FIGS. 36A through 36C in a complete condition.

As shown in FIG. 36A, in the illustrative embodiment, the conductor 15 is wound round a core 17 with its opposite ends 15*a* held straight. As shown in FIG. 36B, the conductor 15 wound round the core 17 is inserted into the bobbin member 12 to thereby form a coil. Subsequently, as shown in FIG. 36C, the ends 15*a* of the conductor 15 are bent inward to complete the coil. The other bobbin members 11 and 13 are dealt with in the same manner as the bobbin member 12 in order to form respective coils. As shown in FIG. 37, the resulting bobbin members 11 through 13 are coupled with their coils being connected to each other. By such a procedure, the induction heating coil 3 with a plurality of coils arranged on its inner periphery can be easily produced.

Figure 38:
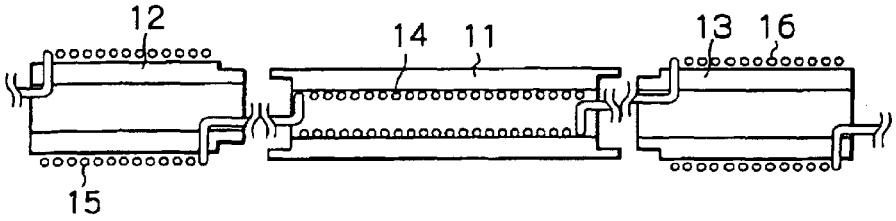
FIG. 38 is a view showing a modification of the embodiment shown in FIGS. 33A through 33C.

Alternatively, as shown in FIG. 38, the conductor 14 may be wound on the inner periphery of the bobbin member 11 while the conductors 15 and 16 may be wound on the outer peripheries of the bobbin members 12 and 13, respectively. This can also be done with ease. When the bobbin member 11 with the conductor 14 wound on its inner periphery is positioned at the center of the induction heating coil 3, air sent into the coil 3 for a cooling purpose can cool off the center conductor 14 more efficiently than in the configuration shown in FIGS. 33*a* through 33C. Therefore, for the conductor 11, a copper wire relatively low in heat resistance can be used.

The configuration shown in FIG. 37 allows all the coils to be easily, efficiently cooled off. However, configuring the coils on the inner periphery of the bobbin members consumes more time and more labor than configuring them on the outer peripheries of the same. By contrast, the configuration shown in FIG. 38 allows the center coil whose temperature is likely rise more than the other coils to be easily cooled off. In addition, the configuration. of FIG. 38 allows the end coils sandwiching the center coil to be easily configured.

Figure 39:
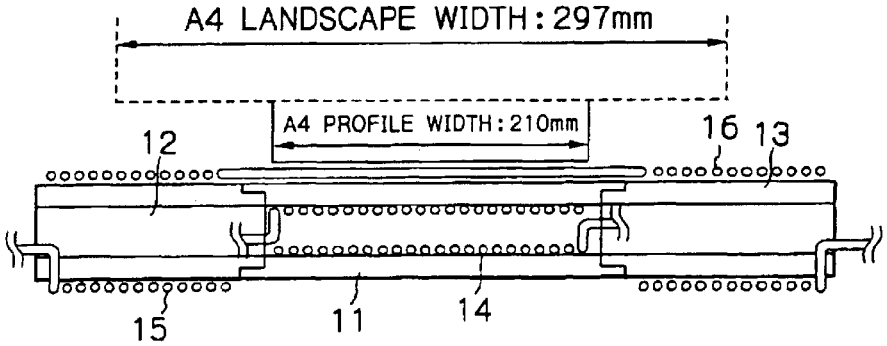
FIG. 39 is a view showing a more specific configuration of the embodiment shown in FIGS. 33A through 33C.

More specifically, assume an image forming apparatus having the maximum sheet passing width corresponding to the A3 profile position, and passing a paper sheet by using the center as a reference. Then, as shown in FIG. 39, it is preferable to provide the center coil 14 with a size corresponding to the A4 profile size and provide the entire coil assembly with a size corresponding to the A4 landscape size for the following reasons. Because current flows through the center coil 14 substantially throughout the operation of the fixing device, the coil 14 should preferably be arranged on the inner periphery of the bobbin member 11 and efficiently cooled. The end coils 12 and 13 may be arranged on the outer peripheries of the bobbin members 12 and 13 because current does not flow therethrough when the sheet size is equal to or smaller than the A4 profile size.

Further, in the image forming apparatus of the type described, the coil assembly made up of the main coil 14 and auxiliary coils 15 and 16 is provided with a length equal to or slightly greater than lateral dimension of size A4. The main coil 14 is provided with a length equal to or slightly greater than the longitudinal dimension of size A4. The main coil 14 covers the main range of the heat roller corresponding to the A4 profile size while the auxiliary coils 15 and 16 cover the auxiliary ranges outside of the main range. In this condition, it is possible to cause current to flow only through the main coil 11 for a paper sheet fed in the A4 profile position or to cause it to flow through both of the main coil 11 and auxiliary coils 12 and 13 for a paper sheet fed in the A4 landscape position.

Figure 40:
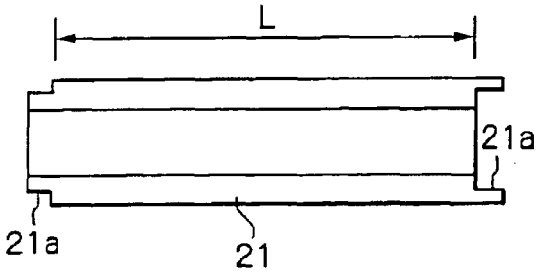
FIG. 40 is a view showing a modified bobbin member included in the embodiment of FIGS. 33A through 33C.

FIG. 40 shows a modified bobbin 21. As shown, the bobbin 21 is formed with a projection 21*a* and a recess 21*b* at opposite ends thereof, respectively. By producing such bobbins identical in configuration, it is possible to connect any number of bobbins in accordance with the desired overall length of a coil assembly. For example, assuming that each bobbin 21 has a length L slightly greater than 5 cm, then a single bobbin may be assigned to each end bobbin member of FIG. 39 while four bobbins may be assigned to the center bobbin member.

As stated above, the illustrative embodiment has various advantages, as enumerated below.

(1) A plurality of bobbin members are removably connected together. This facilitates the configuration of the individual coil and allows any one of the coils to be replaced.

(2) The,individual coil wound round the respective bobbin is short and easy to wind.

(3) The coils are arranged on the inner peripheries of the bobbin members and can therefore be easily cooled off. It follows that the coils can be implemented by copper wires relatively low in heat resistance, reducing the cost of the fixing device.

(4) The coils are selectively arranged on the inner peripheries or the outer peripheries of the bobbin members. Therefore, the center coil whose temperature is apt to rise more than the end coils can be efficiently cooled off.

(5) After the coils have been arranged on the respective bobbin members, the bobbin members are connected together. The coils are therefore easy to configure.

(6) The irregular temperature distribution of the heat roller is reduced, so that attractive images are achievable. In addition, the coils are easy to configure and inexpensive because they can be cooled off.

Various modifications will become possible for those skilled in the art after receiving the teachings of the present disclosure without departing from the scope thereof.

What is claimed:

1. An induction heating coil for an induction heating type fixing device including a heat roller, comprising:

a main coil having two leads positioned inside said heat roller at a center portion substantially corresponding to a main sheet passing range;

a first auxiliary coil having two leads positioned inside said heat roller at a first portion other than the center portion, said first portion being located on a first side of the center portion and substantially corresponding to an auxiliary sheet passing range; and a second auxiliary coil having two leads positioned inside said heat roller at a second portion other than the center portion, said second portion being located on a second side of the center portion opposite the first side and substantially corresponding to said auxiliary sheet passing range, wherein one of said two leads of said first auxiliary coil and one of said two leads of said second auxiliary coil are interconnected over said main coil.

2. The induction heating coil as claimed in claim 1, wherein said one of said two leads of said first auxiliary coil and said one of said two leads of said second auxiliary coil are interconnected by a removable connecting device.

3. An induction heating coil for an induction heating fixing device including a heat roller, comprising:

a main coil positioned inside said heat roller at a center portion substantially corresponding to a main sheet passing range;

a first auxiliary coil positioned inside said heat roller at a first portion other than the center portion, said first portion being located on a first side of the center portion and substantially corresponding to an auxiliary sheet passing range; and a second auxiliary coil positioned inside said heat roller at a second portion other than the center portion, said second portion being located on a second side of the center portion opposite the first side and substantially corresponding to said auxiliary sheet passing range, wherein each of said main coil, first auxiliary coil, and second auxiliary coil includes two leads one of which comprises a flat lead, and said flat lead of said first auxiliary coil and said flat lead of said second auxiliary coil are interconnected over said main coil.

4. The induction heating coil as claimed in claim 3, wherein said flat lead of said main coil is connected to a coil drive circuit over one of the first and second auxiliary coils.

5. The induction heating coil as claimed in claim 4, wherein said flat leads of said main coil, first auxiliary coil, and second auxiliary coil each comprises a thin, flat sheet formed of a conductive material.

6. The induction heating coil as claimed in claim 4, wherein said flat leads of said main coil, first auxiliary coil, and second auxiliary coil each comprises a litz wire.

7. The induction heating coil as claimed in claim 6, wherein each of said two leads of said main coil, first auxiliary coil, and second auxiliary coil has a sectional area equal to or greater than a cross-sectional area of the litz wire.

8. The induction heating coil as claimed in claim 7, wherein said flat leads of said main coil, first auxiliary coil, and second auxiliary coil each has a thickness equal to or smaller than a diameter of the litz wire.

9. The induction heating coil as claimed in claim 8, wherein opposite ends of said main coil are coincident with or positioned slightly outward of opposite ends of said main sheet passing range.

10. The induction heating coil as claimed in claim 3, wherein said flat leads of said main coil, first auxiliary coil, and second auxiliary coil each comprises a litz wire.

11. The induction heating coil as claimed in claim 10, wherein each of said two leads of said main coil, first auxiliary coil, and second auxiliary coil has a sectional area equal to or greater than a cross-sectional area of the litz wire.

12. The induction heating coil as claimed in claim 11, wherein said flat leads of said main coil, first auxiliary coil, and second auxiliary coil each has a thickness equal to or smaller than a diameter of the litz wire.

13. The induction heating coil as claimed in claim 12, wherein opposite ends of said main coil are coincident with or positioned slightly outside of opposite ends of said main sheet passing range.

14. The induction heating coil as claimed in claim 3, wherein each of said two leads of said main coil, first auxiliary coil, and second auxiliary coil has a sectional area equal to or greater than a cross-sectional area of a litz wire.

15. The induction heating coil as claimed in claim 14, wherein said flat leads of said main coil, first auxiliary coil, and second auxiliary coil each has a thickness equal to or smaller than a diameter of the litz wire.

16. The induction heating coil as claimed in claim 15, wherein opposite ends of said main coil are coincident with or positioned slightly outward of opposite ends of said main sheet passing range.

17. The induction heating coil as claimed in claim 3, wherein said flat leads of said main coil, first auxiliary coil, and second auxiliary coil each has a thickness equal to or smaller than a diameter of a litz wire.

18. The induction heating coil as claimed in claim 17, wherein opposite ends of said main coil are coincident with or positioned slightly outward of opposite ends of said main sheet passing range.

19. The induction heating coil as claimed in claim 3, wherein opposite ends of said main coil are coincident with or positioned slightly outward of opposite ends of said main sheet passing range.

20. An image forming apparatus comprising:

a fixing device configured to fix a toner image on a recording medium and including a heat roller; and an induction heating coil including, a main coil positioned inside said heat roller at a center portion substantially corresponding to a main sheet passing range, a first auxiliary coil positioned inside said heat roller at a first portion other than the center portion, said first portion being located on a first side of the center portion and substantially corresponding to an auxiliary sheet passing range, and a second auxiliary coil positioned inside said heat roller at a second portion other than the center portion, said second portion being located on a second side of the center portion opposite the first side and substantially corresponding to said auxiliary sheet passing range, wherein each of said main coil, first auxiliary coil, and second auxiliary coil includes two leads one of which comprises a flat lead, and said flat lead of said first auxiliary coil and said flat lead of said second auxiliary coil are interconnected over said main coil.

21. The apparatus as claimed in claim 20, wherein said flat lead of said main coil is connected to a coil drive circuit over one of the first and second auxiliary coils.

22. The apparatus as claimed in claim 20, wherein said flat leads of said main coil, first auxiliary coil, and second auxiliary coil each comprises a thin, flat sheet formed of a conductive material.

23. The apparatus as claimed in claim 20, wherein said flat leads of said main coil, first auxiliary coil, and second auxiliary coil each comprises a litz wire.

24. The apparatus as claimed in claim 20, wherein each of said two leads of said main coil, first auxiliary coil, and second auxiliary coil has a sectional area equal to or greater than a cross-sectional area of a litz wire.

25. The apparatus as claimed in claim 20, wherein said flat leads of said main coil, first auxiliary coil, and second auxiliary coil each has a thickness equal to or smaller than a diameter of a litz wire.

* * * * *

UNITED STATES PATENT AND TRADEMARK OFFICE

CERTIFICATE OF CORRECTION

PATENT NO. : 6,946,629 B2
DATED : September 20, 2005
INVENTOR(S) : Miyahara et al.

It is certified that error appears in the above-identified patent and that said Letters Patent is hereby corrected as shown below:

Title page,
Item [30], should read:
-- [30] Foreign Application Priority Data

| | | |
|---|---|---|
| Apr. 28, 2000 | (JP) | 2000-130934 |
| Apr. 28, 2000 | (JP) | 2000-130935 |
| Jul. 31, 2000 | (JP) | 2000-231577 |
| Aug. 7, 2000 | (JP) | 2000-238403 |
| Feb. 26, 2001 | (JP) | 2001-050654 --. |

Signed and Sealed this

Twenty-second Day of November, 2005

JON W. DUDAS
*Director of the United States Patent and Trademark Office*